US005212524A

United States Patent [19]

Tanikawa et al.

[11] Patent Number: 5,212,524

[45] Date of Patent: May 18, 1993

[54] TONER FOR DEVELOPING ELECTROSTATIC IMAGES, IMAGE FORMING METHOD AND IMAGE FORMING APPARATUS

[75] Inventors: Hirohide Tanikawa; Yasutaka Akashi, both of Yokohama; Masaki Uchiyama, Ichikawa; Makoto Unno, Tokyo; Masaaki Taya, Kawasaki, all of Japan

[73] Assignee: Canon Kabushiki Kaisha, Tokyo, Japan

[21] Appl. No.: 937,114

[22] Filed: Aug. 31, 1992

Related U.S. Application Data

[62] Division of Ser. No. 604,207, Oct. 29, 1990, Pat. No. 5,169,738.

[30] Foreign Application Priority Data

Nov. 9, 1989 [JP] Japan ..... 1-289882
Mar. 2, 1990 [JP] Japan ..... 2-051196

[51] Int. Cl.[5] ..... G03G 15/09

[52] U.S. Cl. ..... 355/251; 118/657; 118/658; 355/253; 430/106.6

[58] Field of Search ..... 430/106.6, 109; 355/245, 251, 253; 118/653, 656, 657, 658

[56] References Cited

U.S. PATENT DOCUMENTS 2,297,691 10/1942 Carlson ..... 95/5
3,666,363 5/1972 Tanaka et al. ..... 355/211 X
4,071,361 1/1978 Marushima ..... 96/1.4
4,653,427 3/1987 Hosaka et al. ..... 118/658
4,657,374 4/1987 Kuramoto et al. ..... 335/251
4,760,007 7/1988 Takasu et al. ..... 430/122
4,935,784 6/1990 Shigehiro et al. ..... 355/253
5,001,517 3/1991 Hosaka et al. ..... 355/251 X

FOREIGN PATENT DOCUMENTS 59-139053 8/1984 Japan .
61-123855 6/1986 Japan .
61-123856 6/1986 Japan .
61-123857 6/1986 Japan .
62-280758 12/1987 Japan .
63-94251 4/1988 Japan .
63-193154 8/1988 Japan .

*Primary Examiner*—A. T. Grimley
*Assistant Examiner*—Sandra L. Brasé
*Attorney, Agent, or Firm*—Fitzpatrick, Cella, Harper & Scinto

[57] ABSTRACT

A toner for developing electrostatic images, comprises a binder resin and a colorant, wherein the binder resin comprises a vinyl copolymer having an acid anhydride group, and the binder resin has a total acid value (A) of 2-100 mgKOH/g and a total acid value (B) attributable to acid anhydride group of below 6 mgKOH/g so that $[(B)/(A)] \times 100$ is 60% or less. Because the binder resin has a specified acid value partly attributable to acid anhydride group, the toner is provided with an adequate balance between chargeability and dischargeability, so that the toner shows a stable performance under various environmental conditions. The toner is particularly advantageously constituted as a magnetic toner of fine particle sizes suitably used under application of unsymmetrical alternating bias electric field.

6 Claims, 3 Drawing Sheets

TONER FOR DEVELOPING ELECTROSTATIC IMAGES, IMAGE FORMING METHOD AND IMAGE FORMING APPARATUS

This application is a division of application Ser. No. 07/604,207, filed Oct. 29, 1990, now U.S. Pat. No. 5,169,738.

FIELD OF THE INVENTION AND RELATED ART

The present invention relates to a toner for developing electrostatic images used in image forming processes, such as electrophotography, electrostatic printing and electrostatic recording, an image forming apparatus using the toner, and an image forming apparatus therefor.

Hitherto, a large number of electrophotographic processes have been known, inclusive of those disclosed in U.S. Pat. Nos. 2,297,691; 3,666,363; and 4,071,361. In these processes, in general, an electrostatic latent image is formed on a photosensitive member comprising a photoconductive material by various means, then the latent image is developed with a toner, and the resultant toner image is, after being transferred onto a transfer material such as paper etc., as desired, fixed by heating, pressing, or heating and pressing, or with solvent vapor to obtain a copy.

With respect to the above-mentioned final step of fixing a toner image onto a sheet of, e.g., paper, various methods and apparatus have been developed, of which the most popular one is of the heating and pressing system using hot rollers.

In the heating and pressing system, a sheet carrying a toner image to be fixed (hereinafter called "fixation sheet") is passed through hot rollers, while a surface of a hot roller having a releasability with the toner is caused to contact the toner image surface of the fixation sheet under pressure, to fix the toner image. In this method, as the hot roller surface and the toner image on the fixation sheet contact each other under a pressure, a very good heat efficiency is attained for melt-fixing the toner image onto the fixation sheet to afford quick fixation, so that the method is very effective in a high-speed electrophotographic copying machine.

For such a fixing method, it has been proposed to use a binder resin containing an acid component for improving the fixing characteristic. However, a toner using such a binder resin is liable to be charged insufficiently under a high-humidity condition and charged excessively under a low-humidity condition, thus being liable to be affected by changes in environmental conditions. In some cases, such a toner is liable to cause fog or provide a low image density.

On the other hand, an acid anhydride has a function of increasing the chargeability, and the use of a resin containing an acid anhydride has been proposed, for example, by Japanese Laid-Open Patent Applications (JP-A) 59-139053 and 62-280758. These references show a method wherein a polymer containing acid anhydride units at a high density is diluted with a binder resin. In such a method, it is necessary to uniformly disperse the acid anhydride-containing resin in the binder resin, and the failure of uniform dispersion causes nonumiform charge of toner particles to be liable to cause fog and adversely affect the developing performance. These methods are liable to provide a negative chargeability and are not adequately applied to a positively chargeable toner.

If acid anhydride units are dispersed and diluted by copolymerization with polymer chains constituting the binder resin, the above-mentioned problem of nonumiform dispersion can be dissolved to provide toner particles with a uniform chargeability. Such toner are disclosed in, e.g., JP-A 61-123856 and 61-123857 and are known to provide good fixation characteristic, anti-offset characteristic and developing characteristic.

Such toners can however be charged excessively when applied to a high-speed copying machine under a low-humidity condition, thus leading to a possibility of fog or a decrease in density. This is because the acid anhydride units in the binder resin contained in these toners are larger in contact while they may be uniformly dispersed.

SUMMARY OF THE INVENTION

An object of the present invention is to provide a toner for developing electrostatic images having solved the above-mentioned problems.

A more specific object of the invention is to provide a toner for developing electrostatic images, which provides high-density toner images free from fog without impairing the fixing characteristic.

An object of the invention is to provide a toner for developing electrostatic images, which is little affected by environmental changes and provides good images under both low-humidity and high-humidity conditions.

An object of the invention is to provide a toner for developing electrostatic images, which stably provides good images even for a high-speed image forming apparatus and is thus applicable to a wide variety of apparatus.

Another object of the present invention is to provide an image forming method and an image forming apparatus using such a specific toner as described above and an unsymmetrical developing bias voltage.

An object of the invention is to provide an image forming method and an image forming apparatus which are excellent in durability and are capable of stably providing toner images having a high image density and free from white ground fog even in a long period of continuous use.

An object of the invention is to provide an image forming method and an image forming apparatus capable of providing toner images which are rich in gradation characteristic and excellent in resolution and thin line reproducibility.

An object of the invention is to provide an image forming method and an image forming apparatus capable of stably providing toner images having a high image density even under a low humidity condition.

An object of the invention is to provide an image forming method and an image forming apparatus wherein a magnetic toner is uniformly applied on a toner-carrying member and is also uniformly charged stably and not excessively or not insufficiently, so that the flying of the magnetic toner is made more effective.

An object of the invention is to provide an image forming method and an image forming apparatus wherein the toner-carrying member memory is prevented or suppressed.

An object of the invention is to provide an image forming method and an image forming apparatus wherein an electrostatic latent image formed on an a-Si (amorphous silicon) photosensitive member is effectively developed.

An object of the invention is to provide an image forming method and an image forming apparatus which are capable of providing a sufficient image even by using an a-Si photosensitive member having a low surface potential.

An object of the invention is to provide an image forming method and an image forming apparatus wherein even a small potential contrast on an a-Si photosensitive member can be faithfully developed to provide a gradational image.

An object of the invention is to provide an image forming method and an image forming apparatus wherein a delicate latent image formed on an a-Si photosensitive member is faithfully developed to provide a toner image excellent in thin line reproducibility and resolution.

A further object of the invention is to provide an image forming method and an image forming apparatus by which a high developing speed and a high durability are realized by using an a-Si photosensitive member.

According to the present invention, there is provided a toner for developing electrostatic images, comprising: a binder resin and a colorant, wherein the binder resin comprises a vinyl copolymer having an acid anhydride group, and the binder resin has a total acid value (A) of 2–100 mgKOH/g and a total acid value (B) attributable to acid anhydride group of below 6 mgKOH/g so that [(B)/(A)9 $\times$100 is 60% or less.

According to another aspect of the present invention, there is provided to image forming method, comprising:

disposing a latent image-bearing member for holding an electrostatic image thereon and a toner-carrying member for carrying a magnetic toner with a prescribed gap at a developing station; the magnetic toner comprising a binder resin and magnetic powder and having a volume-average particle size of 4–10 microns, wherein the binder resin comprises a vinyl copolymer having an acid anhydride group, and the binder resin has a total acid value (A) of 2–100 mgKOH/g and a total acid value (B) attributable to acid anhydride group of below 6 mgKOH/g so that [(B)/(A)]$\times$100 is 60% or less;

conveying the magnetic toner in a layer carried on the toner-carrying member and regulated in a thickness thinner than the prescribed gap to the developing station; and applying an alternating bias voltage comprising a DC bias voltage and an unsymmetrical AC bias voltage in superposition between the toner-carrying member and the latent image-bearing member at the developing station to provide an alternating bias electric field comprising a development-side voltage component and a reverse-development side voltage component, the development-side voltage component having a magnitude equal to or larger than that of the reverse development-side voltage component and a duration smaller than that of the reverse-development side voltage component, so that the magnetic toner on the toner-carrying member is transferred to the latent image-bearing member to develop the electrostatic image thereon at the developing station.

According to still another aspect of the present invention, there is provided an image forming apparatus, comprising: a latent image-bearing member for holding an electrostatic image thereon, a toner-carrying member for carrying a layer of a magnetic toner thereon, a toner vessel for holding the magnetic toner to be supplied to the toner-carrying member, a toner layer-regulating member for regulating the magnetic toner layer on the toner-carrying member, and a bias application means for applying an alternating bias voltage comprising a DC bias voltage and an unsymmetrical AC bias voltage in superposition between the toner-carrying member and the latent image-bearing member, wherein the latent image-bearing member and the toner-carrying member are disposed with a prescribed gap therebetween at a developing station;

the toner layer-regulating means is disposed to regulate the magnetic toner layer on the toner-carrying member in a thickness thinner than the prescribed gap;

the magnetic toner comprises a binder resin and magnetic powder and has a volume-average particle size of 4–10 microns, the binder resin comprises a vinyl copolymer having an acid anhydride group, and the binder resin has a total acid value (A) of 2–100 mgKOH/g and a total acid value (B) attributable to acid anhydride group of below 6 mgKOH/g so that [(B)/(A)]$\times$100 is 60% or less; and the bias application means is disposed to provide an alternating bias electric field comprising a development-side voltage component and a reverse-development side voltage component, the development-side voltage component having a magnitude equal to or larger than that of the reverse development-side voltage component and a duration smaller than that of the reverse-development side voltage component, so that the magnetic toner on the toner-carrying member is transferred to the latent image-bearing member to develop the electrostatic image thereon at the developing station.

These and other objects, features and advantages of the present invention will become more apparent upon a consideration of the following description of the preferred embodiments of the present invention taken in conjunction with the accompanying drawings.

DESCRIPTION OF THE INVENTION

Figure 1:
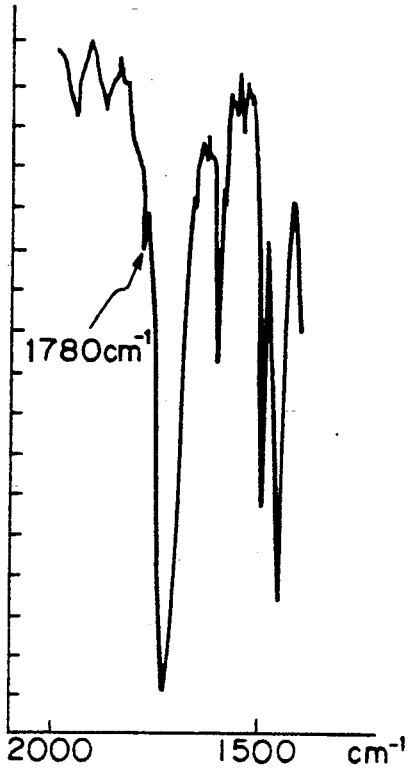
FIG. 1 is an infrared absorption spectrum of a binder resin according to the present invention in the neighborhood of 1780 $cm^{-1}$.

The binder resin used in the toner according to the present invention is characterized by having an acid value, more specifically a total acid value (A) of 2–100 mgKOH/g, preferably 5–70 mgKOH/g, further preferably 5–50 mgKOH/g, measured under the condition that the acid anhydride group is hydrolyzed, so as to improve the fixing characteristic.

If the total acid value (A) is below 2 mgKOH/g, it is difficult to obtain a good fixing characteristic. Above 100 mgKOH/g, the chargeability of the toner cannot be controlled easily.

The acid value may be provided by a carboxyl group and an acid anhydride group, and these functional groups greatly affect the chargeability of the toner. For example, a carboxyl group in a polymer chain is able to impart a weak negative chargeability. However, if the content of a carboxyl group is increased, the resin is caused to have an increased hydrophilicity so that it is liable to liberate its charge to moisture in the air. This tendency becomes noticeable as the content of the carboxyl group is increased.

On the other hand, an acid anhydride group has a negative-charge imparting ability but has no or very little dischargeability. A binder resin having these functional groups may have a negative chargeability, so that it is advantageously used for providing a negatively chargeable toner but can be used to also provide a positively chargeable toner by selection of a charge control agent. More specifically, in case where the charge-imparting ability of the positive charge control agent is predominant over the negative charge-imparting ability of the functional group in the resin, the functional group functions to control the liberation of a positive charge.

Accordingly, the proportion of such a functional group is important for stabilizing the chargeability of a toner. The carboxyl group functions to discharge as well as to impart a chargeability.

On the other hand, the acid anhydride group functions effectively only to impart a chargeability. If the carboxyl group is present in a large proportion, there occurs frequent discharge to result in an insufficient toner charge, so that it becomes difficult to obtain a sufficient image density. This tendency is pronounced under a high-humidity condition.

On the other hand, if the acid anhydride group is present in a large proportion, the toner chargeability is liable to be excessive to increase fog. This tendency is pronounced under a low humidity condition to result in an insufficient image density.

If these functional groups are co-present in appropriate proportions, the charge imparting and the charge liberation can be adequately balanced to stabilize the toner chargeability, so that the influence of the environmental change on the toner chargeability can be minimized.

According to the present invention, the chargeability is imparted by the presence of an acid anhydride group and also the charge liberation is promoted by the presence of a carboxyl group to prevent excessive charge-up of the toner.

The binder resin according to the present invention is also characterized by having a total acid value (B) attributable to the acid anhydride group of 6 kgKOH/g or lower. Above 6 mgKOH/g, the toner becomes excessively chargeable and is liable to cause a decrease in density and fog under a low-humidity condition.

The total acid value (B) is preferably from 0.1 mgKOH/g to below 6 mgKOH/g, more preferably in the range of 0.5–5.5 mgKOH/g.

The total acid value (B) attributable to the acid anhydride group is set to be 60% or less, preferably 50% or less, further preferably 40% or less, of the total acid value (A) of the entire binder resin. Above 60%, the charge-imparting and the charge liberation lack a balance so that the charge-imparting ability becomes predominant and the toner is liable to be charged excessively. The ratio $[(B)/(A)]\times 100$ is preferably 1–60%, more preferably 2–50%, further preferably 3–40%.

The presence of an acid anhydride group in the binder resin according to the present invention is confirmed by the presence of an absorption peak (in the range of about 1750 $cm^{-1}$ – 1850 $cm^{-1}$) attributable to the acid anhydride group in the infrared (IR) absorption spectrum thereof. The observable presence of such an absorption peak is sufficient to provide a sufficient triboelectric charge stability of the toner.

The absorption peak attributable to the carbonyl in an acid anhydride group appears at a higher wave member than the one in the corresponding ester group or acid group, so that the presence thereof can be confirmed.

The binder resin according to the present invention may be obtained from vinyl monomers as shown below.

More specifically, examples of vinyl monomers providing the binder resin with an acid value may include: unsaturated dibasic acids, such as maleic acid, citraconic acid, alkenylsuccinic acid, fumaric acid, and mesaconic acid; unsaturated dibasic acid anhydrides, such as maleic anhydride, citraconic anhydride, itaconic anhydride, and alkenylsuccinic anhydride; half esters of unsaturated dibasic acids, such as monomethyl maleate, monoethyl maleate, monobutyl maleate, monomethyl citraconate, monoethyl citraconate, monobutyl citraconate, monomethyl itaconate, monomethyl alkenylsuccinate, monomethyl fumarate, and monomethyl mesaconate; and unsaturated dibasic acid esters, such as dimethyl maleate and dimethyl fumarate. Also enumerated one: $\alpha,\beta$-unsaturated acids, such as acrylic acid, methacrylic acid, crotonic acid, and cinnamic acid; $\alpha,\beta$-unsaturated acid anhydrides, such as crotonic anhydride, cinnamic anhydride; anhydrides between such $\alpha,\beta$-unsaturated acid and lower fatty acids; alkenylmalonic acid, alkenylglutaric acid, alkenyladipic acid, anhydrides of these acids, and monoesters of these acids.

Among the above, monoesters of $\alpha,\beta$-unsaturated dibasic acids, such as maleic acid, fumaric acid and succinic acid may particularly preferably be used as vinyl monomers for providing the binder resin according to the present invention.

In order to produce vinyl copolymers with the above-mentioned acidic vinyl monomers, and also produce another binder resin component, another vinyl monomer may be used, examples of which may include: styrene; styrene derivatives, such as o-methylstyrene, m-methylstyrene, p-methylstyrene, p-methoxystyrene, p-phenylstyrene, p-chlorostyrene, 3,4-dichlorostyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, and p-n-dodecylstyrene; ethylenically unsaturated monoolefins, such as ethylene, propylene, butylene, and isobutylene; unsaturated polyenes, such as butadiene; halogenated vinyls, such as vinyl chloride, vinylidene chloride, vinyl bromide, and vinyl fluoride; vinyl esters, such as vinyl acetate, vinyl propionate, and vinyl benzoate; methacrylates, such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; acrylates such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate, and phenyl acrylate, vinyl ethers, such as vinyl methyl ether, vinyl ethyl ether, and vinyl isobutyl ether; vinyl ketones, such as vinyl methyl ketone, vinyl hexyl ketone, and methyl isopropenyl ketone; N-vinyl compounds, such as N-vinylpyrrole, N-vinylcarbazole, N-vinylindole, and N-vinyl pyrrolidone; vinylnaphthalenes; acrylic acid derivatives or methacrylic acid derivatives, such as acrylonitrile, methacryronitrile, and acrylamide; the esters of the above-mentioned $\alpha,\beta$-unsaturated acids and the diesters of the above-mentioned dibasic acids. These vinyl monomers may be used singly or in combination of two or more species.

Among these, a combination of monomers providing styrene-type copolymers and styrene-acrylic type copolymers may be particularly preferred.

The binder resin according to the present invention can be a crosslinked polymer, as desired, obtained by using a crosslinking monomer which may be a monomer having two or more polymerizable double bonds. Examples thereof may be enumerated as follows.

Aromatic divinyl compounds, such as divinylbenzene and divinylnaphthalene; diacrylate compounds connected with an alkyl chain, such as ethylene glycol diacrylate, 1,3-butylene glycol diacrylate, 1,4-butanediol diacrylate, 1,5-pentanediol diacrylate, 1,6-hexanediol diacrylate, and neopentyl glycol diacrylate, and compounds obtained by substituting methacrylate groups for the acrylate groups in the above compounds; diacrylate compounds connected with an alkyl chain including an ether bond, such as diethylene glycol diacrylate, triethylene glycol diacrylate, tetraethylene glycol diacrylate, polyethylene glycol #400 diacrylate, polyethylene glycol #600 diacrylate, dipropylene glycol diacrylate and compounds obtained by substituting methacrylate groups for the acrylate groups in the above compounds; diacrylate compounds connected with a chain including an aromatic group and an ether bond, such as polyoxyethylene(2)-2,2-bis(4-hydroxyphenyl)propanediacrylate, polyoxyethylene(4)-2,2-bis(4-hydroxyphenyl)propanediacrylate, and compounds obtained by substituting methacrylate groups for the acrylate groups in the above compounds; and polyester-type diacrylate compounds, such as one known by a trade name of MANDA (available from Nihon Kayaku K. K.). Polyfunctional crosslinking agents, such as pentaerythritol triacrylate, trimethylethane triacrylate, trimethylolethane tetracrylate, oligoester acrylate, and compounds obtained by substituting methacrylate groups for the acrylate groups in the above compounds; triallyl cyanurate and triallyl trimellitate.

These crosslinking agents may preferably be used in a proportion of about 0.01–5 wt. parts, particularly about 0.03–3 wt. parts, per 100 wt. parts of the other monomer components.

Among the above-mentioned crosslinking monomers, aromatic divinyl compounds (particularly, divinylbenzene) and diacrylate compounds connected with a chain including an aromatic group and an ether bond may suitably be used in a toner resin in view of fixing characteristic and anti-offset characteristic.

The vinyl copolymer having an acid anhydride group thus obtained constituting the binder resin according to the present invention may be mixed, as desired, with another binder resin component which may be a homopolymer or copolymer of the above-mentioned vinyl monomers, polyester, polyurethane, epoxy resin, polyvinyl butyral, rosin, modified rosin, terpene resin, phenolic resin, aliphatic or alicyclic hydrocarbon resin, aromatic petroleum resin, haloparaffin, or paraffin wax.

The qualitative and quantitative determination of the functional groups in the binder resin according to the present invention may for example be performed by observation of IR (infrared) absorption spectrum, acid value measurement according JIS (Japanese Industrial Standards) K-0070 and hydrolysis acid value measurement (total acid value measurement).

For example, according to IR absorption, an absorption peak attributable to the carbonyl group in an acid anhydride appears in the neighborhood of 1780 $cm^{-1}$, whereby the presence of an acid anhydride can be confirmed.

In the present invention, a peak in an IR absorption spectrum refers to a peak which can be clearly recognizable after 16 times of integration by means of an FT-IR having a resolution of 4 $cm^{-1}$ (e.g., "FT-IR 1600", available from Perkin-Elmer Co.)

The acid value measured according to JIS K-0070 (hereinafter called "JIS acid value") includes about 50% of the theoretical value of the acid value (i.e., the value equivalent to the corresponding dicarboxylic acid). On the other hand, according to the method of the total acid value (A), substantially the theoretical acid value of the acid anhydride is measured. Accordingly, the difference between the total acid value (A) and the JIS acid value corresponds to about 50% of the theoretical value of the acid anhydride to be measured as a dicarboxylic acid. Thus, the total acid value (B) [mgKOH/g] attributable to the acid anhydride in the binder resin is calculated as follows:

$$\textit{Total acid value (B)} = [\textit{Total acid value (A)} - \textit{JIS acid value}] \times 2.$$

Further, in a case where monooctyl maleate for example is used as an acid component to form a vinyl copolymer composition to be used as a binder resin through solution polymerization and suspension polymerization, the JIS acid value and the total acid value (A) of a vinyl copolymer (with, e.g., styrene and butyl acrylate) obtained by the solution polymerization are measured to provide the total acid value (B) of the vinyl copolymer, and the acid anhydride (maleic anhydride) content (e.g., in mol %) produced in the polymerization and the subsequent solvent removal step can be calculated from the total acid value (B) and the vinyl monomer composition used in the solution polymerization. Further, the vinyl copolymer prepared by the solution polymerization is dissolved in monomers such as styrene and butyl acrylate to form a monomer composition, which is subjected to suspension polymerization. At this time, a part of the acid anhydride group in the previously formed vinyl copolymer causes ring-opening. From the JIS acid value and total acid value (A) of the vinyl copolymer composition obtained by the suspension polymerization and the monomer composition for the suspension polymerization including the vinyl copolymer prepared in the solution polymerization, it is possible to calculate the amounts of the dicarboxylic acid group, acid anhydride group and dicarboxylic acid monoester group in the binder resin.

The total acid value (A) of a binder resin (and of an intermediate resin when required) used herein is measured in the following manner. A sample resin in an amount of 2 g is dissolved in 30 ml of dioxane, and 10 ml of pyridine, 20 mg of dimethylaminopyridine and 3.5 ml of water are added thereto, followed by 4 hours of heat refluxing. After cooling, the resultant solution is titrated with 1/10 N-KOH solution in THF (tetrahydrofuran) to neutrality with phenolphthalein as the indicator to measure the acid value, which is a total acid value (A). Under the above-described condition for measurement of the total acid value (A), an acid anhydride group is hydrolyzed into a dicarboxylic acid group but no acrylic acid ester group, methacrylic acid ester group or dicarboxylic acid monoester group is hydrolyzed.

The above-mentioned 1/10 N-KOH solution in THF is prepared as follows. First 1.5 g of KOH is dissolved in about 3 ml of water, and 200 ml of THF and 30 ml of water are added thereto, followed by stirring. After standing, a uniform clear solution is formed, if necessary, by adding a small amount of methanol if the solution is separated or by adding a small amount of water if the solution is turbid. Then, the factor of the 1/10 N-KOH-THF solution thus obtained is standardized by a 1/10 N-HCl standard solution.

The acid value measurement according to JIS K-0070 is generally as follows.

Reagents as described below are used.

(a) A solvent is prepared as an ethyl ether/ethyl alcohol mixture (1/1 or 2/1) or a benzene/ethyl alcohol mixture (1/1 or 2/1). The solvent is neutralized with a 1/10 N-KOH ethyl alcohol solution with phenolphthalein as the indicator.

(b) A phenolphthalein solution is prepared by dissolving 1 g of phenolphthalein in 100 ml of ethyl alcohol (95 V/V %).

(c) A N/10-KOH ethyl alcohol solution is prepared by 7.0 g of potassium hydroxide in as small an amount as possible and ethyl alcohol (95 V/v %) is added thereto to form 1 l of a mixture, which is caused to stand for 2–3 days and filtrated. The solution is standardized according to JIS K 8006 (Fundamentals relating to titration among quantitative tests of reagents).

The JIS acid value is measured as followed by using the regents.

A sample is accurately weighed, and 100 ml of the solvent and several drops of the phenolphthalein solution as the indicator are added thereto, followed by sufficient shaking until the sample is completely solved. In case of a solid sample, it is dissolved by warming on a water bath. After cooling, the solution is titrated with the N/10 KOH-ethyl alcohol solution until an end point which is judged by continuation of thin red color of the indicator for 30 seconds. The acid value A is calculated by the following equation:

$$A=(B\times f\times 5.611)/S,$$

wherein B: amount(ml) of the N/10-KOH-ethyl alcohol solution, f: factor of the N/10-KOH-ethyl alcohol solution, and S: sample weight(g).

While the binder resin according to the present invention has a total acid value (A) of 2–100 mgKOH/g, the vinyl copolymer contained therein containing an acid component may preferably have a JIS acid value of below 100. If the JIS acid value is 100 or higher, the vinyl copolymer contains a high density of functional group, such as carboxyl groups and acid anhydride groups, so that a good chargeability balance cannot be obtained, and even if it is diluted, the dispersibility thereof is liable to be not adequate.

The binder resin according to the present invention may be produced by polymerization methods, such as bulk polymerization, solution polymerization, suspension polymerization or emulsion polymerization. When a carboxylic acid monomer or an acid anhydride monomer is used, the bulk polymerization or solution polymerization may preferably be used in view of the properties of the monomer.

The vinyl copolymer characteristic of the present invention may for example be obtained through bulk polymerization or solution polymerization by using a monomer, such as an unsaturated dicarboxylic acid; dicarboxylic acid anhydride or dicarboxylic acid monoester. In the solution polymerization, a part of the dicarboxylic acid or dicarboxylic acid monoester may be converted into an acid anhydride structure by appropriately selecting the condition for distilling-off of the solvent. Further conversion into an acid anhydride may be effected by heat-treating the vinyl copolymer obtained through the bulk polymerization or solution polymerization. Further, the acid anhydride structure can be partly esterified by treatment with a compound such as an alcohol.

Reversely, it is also possible to convert the acid anhydride structure in the vinyl copolymer thus obtained into a dicarboxylic acid structure by hydrolysis.

On the other hand, a vinyl copolymer obtained through bulk polymerization or solution polymerization may be subjected to conversion into an anhydride by heating and hydrolysis for ring-opening of the anyhydride to form a dicarboxylic acid unit. If a vinyl copolymer obtained through bulk polymerization or solution polymerization is dissolved in a monomer, followed by suspension polymerization or emulsion polymerization to form a vinyl polymer, a part of the acid anhydride structure in the vinyl copolymer is subjected to ring-opening to form a dicarboxylic unit. It is also possible to dissolve another resin in a monomer at the time of polymerization, followed by heat-treatment of the resultant resin to form an acid anhydride structure, treatment with a weak aqueous alkali solution for ring-opening of the acid anhydride and esterification with alcohol treatment.

As a dicarboxylic acid monomer and a dicarboxylic acid anhydride monomer have a strong tendency of alternate polymerization, a vinyl copolymer containing functional groups such as acid anhydride groups or carboxyl groups at random, may preferably be formed according to the following method, for example. Thus, a vinyl copolymer formed by solution polymerization using a dicarboxylic acid monoester monomer, and the vinyl copolymer is dissolved in a monomer, followed by suspension polymerization to obtain a binder resin. According to this method, all or a part of the dicarboxylic acid monoester structure after the solution polymerization can be converted into acid anhydride groups through de-alcohol ring-closure by selecting the condition for distilling off the solvent. At the time of the suspension polymerization, a part of the acid anhydride groups may cause hydrolysis ring-opening to form dicarboxylic acid units.

The formation or disappearance of the acid anhydride units in the polymer can be confirmed by the shift of the absorption peak by a carbonyl group toward a higher wave number side in the acid anhydride group than in the acid or ester group.

In the binder resin thus formed, the (di)carboxyl group and acid anhydride group are uniformly dispersed, so that the binder resin can provide the resultant toner with a good chargeability.

The toner for developing electrostatic images according to the present invention can be further used in combination with a charge control agent, as desired, so as to further stabilize its chargeability. Such a charge control agent may preferably be used in a proportion of 0.1–10 wt. parts, particularly 0.1–5 wt. parts, per 100 wt. parts of the binder resin.

Charge control agents known nowadays in the field may include those enumerated below.

The charge control agent for imparting a negative chargeability to the toner may include organometal complexes and chelate compounds as effective ones, which may in turn include: monoazo metal complexes, and metal complexes of aromatic hydroxycarboxylic acids and aromatic dicarboxylic acids. Other examples may include: aromatic hydroxycarboxylic acid, aromatic mono- and polycarboxylic acids, and their metal salts, anhydrides and esters, and biphenol derivatives.

Examples of the charge control agent for imparting a positive chargeability to a toner may include: nigrosine and its modified products with aliphatic metal salts; tetraammonium salts, such as tributylbenzylammonium 1-hydroxy-4-naphthosulfonates, and tetrabutylammonium tetrafluoroborates, and onium salts as their homologous, such as phosphonium salts, and their lake pigments; triphenylmethane dyes and their lake pigments (examples of laking agents may include: phosphotungstic acid, phosphomolybdic acid, phosphotungstic-molybdic acid, tannic acid, lauric acid, gallic acid, ferricyanide, and ferrocyanide); metal salts of higher fatty acids; diorganotin oxides, such as dibutyltin oxide, dioctyltin oxide, and dicyclohexyltin oxide; and diorganotin borates such as dibutyltin borate, dioctyltin borate and dicylohexyltin borate. These may be used singly or in combination of two or more species.

Further, it is also possible to use as a positive charge control agent a homopolymer of a nitrogen-containing monomer represented by the formula:

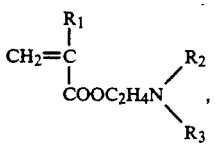

wherein $R_1$ denotes H or $CH_3$, and $R_2$ and $R_3$ respectively denote an alkyl group capable of having a substituent; or a copolymer of the nitrogen-containing monomer with another polymerizable monomer as described above, such as styrene, an acrylate or a methacrylate. The resultant nitrogen-containing homopolymer or copolymer can also function as a part or all of the binder resin.

Among the above, a positive charge control agent, such as a nigrosine-based compound or a tetraammonium salt may be used particularly preferably.

It is preferred to use the toner according to the present invention together with silica fine powder in order to improve the charge stability, developing characteristic and fluidity.

The silica fine powder used in the present invention provides good results if it has a specific surface area of 30 $m^2/g$ or larger, preferably 50–400 $m^2/g$, as measured by nitrogen adsorption according to the BET method. The silica fine powder may be added in a proportion of 0.01–8 wt. parts, preferably 0.1–5 wt. parts, per 100 wt. parts of the toner.

For the purpose of being provided with hydrophobicity and/or controlled chargeability, the silica fine powder may well have been treated with a treating agent, such as silicone varnish, various modified silicone varnish, silicone oil, various modified silicone oil, silane coupling agent silane coupling agent having functional group or other organic silicon compounds, or in combination with another treating agent.

Other additives may also be added, inclusive of: lubricants, such as polytetrafluoroethylene, zinc stearate, and polyvinylidene fluoride (polyvinylidene fluoride being preferred); abrasives, such as cerium oxide, silicon carbide, and strontium titanate (strontium titanate being preferred); fluidity imparting agents, such as titanium oxide and aluminum oxide (hydrophobic ones being preferred); anti-caking agents; electroconductivity-imparting agents, such as carbon black, zinc oxide and tin oxide; and developing characteristic-improving agents, such as white fine particles and black fine particles of a polarity opposite to that of the toner.

It is also preferred to add 0.5–10 wt. parts of waxy substance, such as low-molecular weight polyethylene, low-molecular weight polypropylene, microcrystalline wax, carnauba wax, sasol wax or paraffin wax per 100 wt. parts of the binder resin to the toner for the purpose of improving the releasability of the toner at the time of hot roller fixation.

The toner according to the present invention can be mixed with carrier powder to provide a two-component type developer. In this case, the toner and the carrier powder may be mixed to provide a toner concentration of 0.1–50 wt. %, preferably 0.5–10 wt. %, further preferably 3–5 wt. %.

The carrier to be used in the present invention may be a known one, examples of which may include: magnetic powder, such as iron powder, ferrite powder and nickel powder, and those obtained by treating the surface of such powder with fluorine-containing resin, vinyl resin, silicone resin, etc.

The toner according to the present invention may be constituted as a magnetic toner containing a magnetic material in its particles. In this case, the magnetic material also functions as a colorant. Examples of the magnetic material may include: iron oxide, such as magnetite, hematite, and ferrite; metals, such as iron, cobalt and nickel, and alloys of these metals with other metals, such as aluminum, cobalt, copper, lead, magnesium, tin, zinc, antimony, beryllium, bismuth, cadmium, calcium, manganese, selenium, titanium, tungsten and vanadium; and mixtures of these materials.

The magnetic material may have an average particle size of 0.1–2 microns, preferably 0.1–0.5 microns, and may be contained in the toner in a proportion of 2–200 wt. parts, preferably 40–150 wt. parts, per 100 wt. parts of the resin component.

The magnetic material may preferably have magnetic properties under application of 10 kÖe (kilo-Oersted), inclusive of a coercive force (Hc) of 20–150 Oe, a saturation magnetization $\sigma_s$) of 50–200 emu/g, and a remanence ($\sigma_r$) of 2–20 emu/g.

The colorant which can be used in the invention may be an appropriate dye or pigment. For example, the pigment may include: Carbon Black, Aniline Black, Acetylene Black, Naphthol Yellow, Hansa Yellow, Rhodamine Lake, Alizarin Lake, red iron oxide, Phthalocyanine Blue, and Indanthrene Blue. These pigments may be used in an amount sufficient to provide the fixed image with a sufficient density. More specifically, the pigment may be used in an amount of 0.1–20 wt. parts, preferably 1–10 wt. parts, per 100 wt. parts of the resin. For a similar purpose, it is possible to use a dye, examples of which may include azo dyes, anthraquinone dyes, xanthene dyes and methine dyes. The dye may be used in an amount of 0.1–20 wt. parts, preferably 0.3–10 wt. parts, per 100 wt. parts of the resin.

The toner for developing electrostatic images according to the present invention may be prepared by blending the binder resin, a colorant which may be a pigment, dye or a magnetic material, and other additives as desired inclusive of a charge control agent, etc., by means of a blender, such as Henschel mixer or a ball mill, and melt-kneading the mixture by a hot-kneading means, such as hot rollers, kneader and extruder to form a product wherein metal compounds, and pigments, dye and/or magnetic material are dispersed or dissolved in mutually dissolved resinous substances, followed by cooling for solidification, crushing the solidified product and classification of the crushed product to recover a toner comprising particles having a prescribed particle size distribution.

The toner thus prepared may be further blended with a prescribed additive, as desired, by means of a blender such as a Henschel mixer to form the toner for developing electrostatic images according to the invention wherein the additive are attached to the toner particle surfaces.

When the toner according to the present invention is a magnetic toner having a volume-average particle size of 4–10 microns, it is advantageously applied to an image forming method and an image forming apparatus as described below to provide a very good quality of toner images.

The image forming method comprises the steps of:

disposing a latent image-bearing member for holding an electrostatic image thereon and a toner-carrying member for carrying a magnetic toner with a prescribed gap at a developing station, the magnetic toner comprising a binder resin and magnetic powder;

conveying the magnetic toner in a layer carried on the toner-carrying member and regulated in a thickness thinner than the prescribed gap to the developing station; and applying an alternating bias voltage comprising a DC bias voltage and an unsymmetrical AC bias voltage in superposition between the toner-carrying member and the latent image-bearing member at the developing station to provide an alternating bias electric field comprising a development-side voltage component and a reverse-development side voltage component, the development-side voltage component having a magnitude equal to or larger than that of the reverse development-side voltage component and a duration smaller than that of the reverse-development side voltage component, so that the magnetic toner on the toner-carrying member is transferred to the latent image-bearing member to develop the electrostatic image thereon at the developing station.

The image forming apparatus, comprises: a latent image-bearing member for holding an electrostatic image thereon, a toner-carrying member for carrying a layer of a magnetic toner thereon, a toner vessel for holding the magnetic toner to be supplied to the toner-carrying member, a toner layer-regulating member for regulating the magnetic toner layer on the toner-carrying member, and a bias application means for applying an alternating bias voltage comprising a DC bias voltage and an unsymmetrical AC bias voltage in superposition between the toner-carrying member and the latent image-bearing member, wherein the latent image-bearing member and the toner-carrying member are disposed with a prescribed gap therebetween at a developing station;

the toner layer-regulating means is disposed to regulate the magnetic toner layer on the toner-carrying member in a thickness thinner than the prescribed gap; and the bias application means is disposed to provide an alternating bias electric field comprising a development-side voltage component and a reverse-development side voltage component, the development-side voltage component having a magnitude equal to or larger than that of the reverse development-side voltage component and a duration smaller than that of the reverse-development side voltage component.

Figure 2:
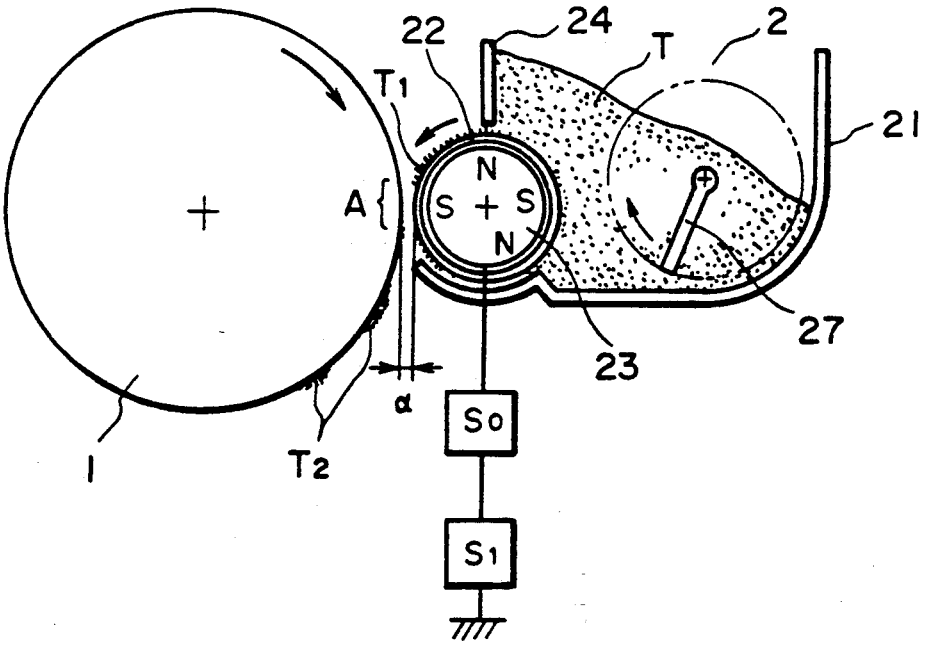
FIG. 2 is a schematic view for illustrating an embodiment of the image forming method and image forming apparatus according to the present invention.

The features of the image forming method and image forming apparatus will be explained with reference to FIG. 2 showing an embodiment of the image forming apparatus according to the present invention.

Referring to FIG. 2, the apparatus includes a latent image-bearing member 1 which can be a latent image-bearing member (so-called photosensitive member), such as a rotating drum, for electrophotography; an insulating member, such as a rotating drum, for electrostatic recording; photosensitive paper for the Electrofax; or electrostatic recording paper for direct electrostatic recording. An electrostatic latent image is formed on the surface of the latent image-bearing member 1 by a latent image forming mechanism or latent image forming means (not shown) and the latent image-bearing member is rotated in the direction of an indicated arrow.

The apparatus also includes a developing apparatus which in turn includes a toner container 21 (hopper) for holding a toner and a rotating cylinder 22 as a toner-carrying member (hereinafter, also called "(developing) sleeve") in which a magnetic field-generating means 23, such as a magnetic roller, is disposed.

Almost a right half periphery (as shown) of the developing sleeve 22 is disposed within the hopper 21 and almost a left hand periphery of the sleeve 22 is exposed outside the hopper. In this state, the sleeve 22 is axially supported and rotated in the direction of an indicated arrow. A doctor blade 24 as a toner layer regulating means is disposed above the sleeve 22 with its lower edge close to the upper surface of the sleeve 22. A stirrer 27 is disposed for stirring the toner within the hopper 21.

The sleeve 22 is disposed with its axis being in substantially parallel with the generatrix of the latent image-bearing member 1 and opposite to the latent image-bearing member 1 surface with a slight gap therefrom.

The surface moving speed (circumferential speed) of the sleeve 22 is substantially identical to or slightly larger than that of the latent-image bearing member 1. Between the latent image-bearing member 1 and the sleeve 22, a DC voltage and an AC voltage are applied in superposition by an AC bias voltage application means $S_0$ and a DC bias voltage application means $S_1$.

In the image forming method of the present invention, not only the magnitude of the alternating bias electric field but also the application time thereof are controlled as well as a triboelectric charge adapted to the controlling developing bias voltage. More specifically, as for the alternating bias, the frequency thereof is not changed, but the development-side bias component is increased while the application time thereof is shortened and correspondingly the reverse development-side bias component is suppressed low while the application time thereof is prolonged, thus changing the duty ratio of the alternating bias voltage.

In the present invention, the development-side bias (voltage) component refers to a voltage component having a polarity opposite to that of a latent image potential (with reference to the toner-carrying member) on the latent image-bearing member (in other words, the same polarity as the toner for developing the latent image), and the reverse development-side bias (voltage) component refers to a voltage component having the same polarity as to the latent image (opposite polarity to the toner).

Figure 3:
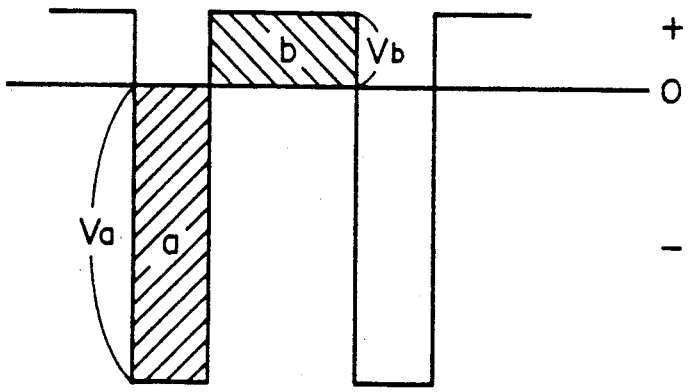
FIGS. 3–6 are waveform diagrams showing unsymmetrical alternating bias voltages.

For example, FIG. 3 shows an example of an unsymmetrical alternating bias voltage comprising an AC bias voltage and a DC bias voltage. FIG. 3 refers to a case where a toner having a negative charge is used for developing a latent image having a positive potential with reference to the toner-carrying member. The part a refers to a development-side bias component and the part b refers to a reverse development-side bias component. The magnitudes of the development-side component and the reverse development-side component are denoted by the absolute values of Va and Vb.

In the present invention, the duty factor of the alternating bias voltage is denoted, except for its DC bias voltage component, as follows:

$$\text{Duty factor} = t_a/(t_a+t_b)\ (\times 100)\ \%,$$

wherein $t_a$ denotes the duration of a voltage component with a polarity for directing the toner toward the latent image-bearing member of one cycle of an AC bias voltage (constituting the developing side bias component a), and $t_b$ reversely denotes the duration a voltage component with a polarity for peeling the toner from the latent image-bearing member of the AC bias voltage (constituting the reverse development-side bias component b). On the other hand, the DC bias voltage may be set between the dark part potential and the light part potential of the latent image-bearing member and may preferably be set so that the alternating bias voltage comprising the AC bias voltage and the DC bias voltage has a voltage component of the same polarity as the development-side bias component which is larger in amplitude than a component of the same polarity as the reverse development-side bias component respectively with respect to the ground level.

Referring again to FIG. 2, almost a right half periphery of the developing sleeve 22 always contacts the toner within the hopper 21, and the toner in the vicinity of the sleeve surface is attached to and held on the sleeve surface under the action of a magnetic force exerted by the magnetic field-generating means 23 disposed in the sleeve 23 and/or an electrostatic force. As the developing sleeve 22 is rotated, the magnetic toner layer held on the sleeve is leveled into a thin toner layer $T_1$ having a substantially uniform thickness when it passes by the position of the doctor blade 24. The charging of the magnetic toner is principally effected by triboelectrification through friction with the sleeve surface and the toner stock in the vicinity of the sleeve surface caused by the rotation of the sleeve 22. The thin magnetic toner layer on the developing sleeve 22 rotates toward the latent image-bearing member 1 as the sleeve rotates and passes a developing station or region A which is the closest part between the latent image-bearing member 1 and the developing sleeve 22. In the course of the passage, the magnetic toner in the magnetic toner layer on the developing sleeve 22 flies under the action of DC and AC voltages applied between the latent image-bearing member 1 and the developing sleeve 22 and reciprocally moves between the latent image-bearing member 1 surface and the developing sleeve 22 surface in the developing region A. Finally, the magnetic toner on the developing sleeve 22 is selectively moved and attached to the latent image-bearing member 1 surface corresponding to a latent image potential pattern thereon to successively form a toner image $T_2$.

The developing sleeve surface having passed by the developing region A and having selectively consumed the magnetic toner thereon rotates back into the toner stock in the hopper 21 to be supplied again with the magnetic toner, whereby the thin toner layer $T_1$ on the developing sleeve 22 is continually moved to the developing region A when developing steps are repeatedly effected.

As described above, a problem accompanying such a developing scheme (non-contact developing method using a monocomponent developer is that a developing performance can be decreased due to an increased force of attachment of magnetic toner particles in the vicinity of the developing sleeve surface in some cases. The magnetic toner and the sleeve always cause friction with each other as the developing sleeve 22 rotates, so that the magnetic toner is gradually caused to have a large charge, whereby the electrostatic force (Coulomb's force) between the magnetic toner and the sleeve is increased to weaken the force of flying of the magnetic toner. As a result, the magnetic toner is stagnant in the vicinity of the sleeve to hinder the triboelectrification of the other toner particles, thus resulting in a decrease in developing characteristic. This particularly occurs under a low humidity condition or through repetition of developing steps. Due to a similar mechanism, the above-mentioned toner-carrying member memory occurs.

The force of flying the magnetic toner from the sleeve toward the latent image-bearing member 1 is required to provide an acceleration $\vec{a}$ so as to cause the magnetic toner to sufficiently reach the latent image surface under the action of an AC bias electric field. If the mass of a toner particle is denoted by m, the force $\vec{f}$ is given by $\vec{f}=m\cdot\vec{a}$. If the charge of the toner particle is denoted by q, the distance from the sleeve is denoted by d and the alternating bias electric field is denoted by $\vec{E}$, the force $\vec{f}$ is roughly given by $\vec{f}=\vec{E}\cdot q - (E\cdot E^0\cdot q^2)/d^2$. Thus, the force of toner reaching the latent image surface is determined by a balance between the electrostatic attraction force with the sleeve and the electric field force.

In this instance, toner particles of 5 microns or smaller which are liable to gather in the vicinity of the developing sleeve can also be propelled if the electric field is increased. However, if the development-side bias voltage is simply increased, the toner is caused to fly toward the latent image side regardless of the latent image pattern. This tendency is strong for toner particles of 5 microns or smaller, thus being liable to cause ground fog. The ground fog can be prevented by increasing the reverse development-side voltage, but if the alternating electric field acting between the latent image-bearing member 1 and the developing sleeve 22 is increased, a discharge is directly caused between the latent image-bearing member 1 and the sleeve 22 to remarkably impair the image quality.

Further, when the reverse development-side voltage is also increased, the toner attached not only to the non-latent image part but also to the latent image pattern (image part) is caused to be peeled. Thus, magnetic toner particles of 8–12.7 microns having a relatively small image force to the latent image-bearing member are liable to be removed so that the coverage on the latent image part becomes poor to cause image defects, such as disturbance of a developed pattern, deterioration of gradation characteristic and line-reproducibility and liability of hollow image (white dropout of a middle part of an image).

From the above results, it is important to cause the toner in the vicinity of the sleeve to fly and reciprocally move without excessively increasing the alternating bias electric field and by suppressing the reverse development-side bias voltage to a low value.

By sufficiently increasing the development-side bias electric field according to the scheme of the present invention, toner particles of 5 microns or smaller on the sleeve which constitute an essential component for improving the image quality can be effectively caused to fly and reciprocally move. As a result, it has become possible to suppress the decrease in image density and toner-carrying member memory.

As the reverse development-side bias electric field is provided with a sufficiently long duration while the magnitude thereof is suppressed, a force for peeling an excessive toner attached to outside the latent image pattern from the latent image-bearing member 1 is given so that ground fog can be prevented.

Figure 4:
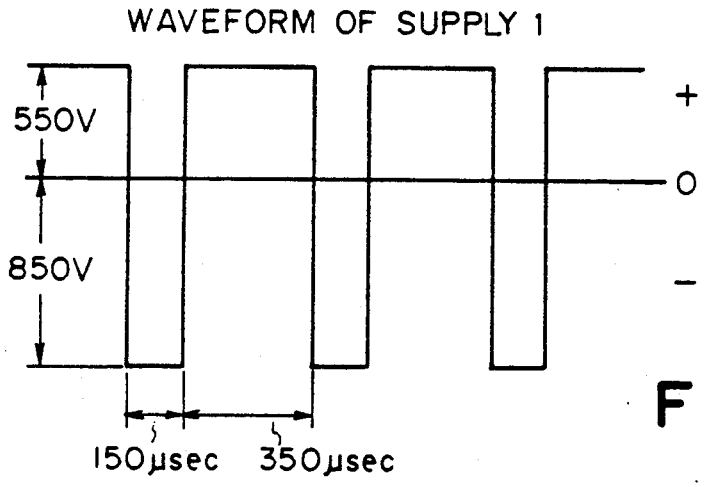
Figure 5:
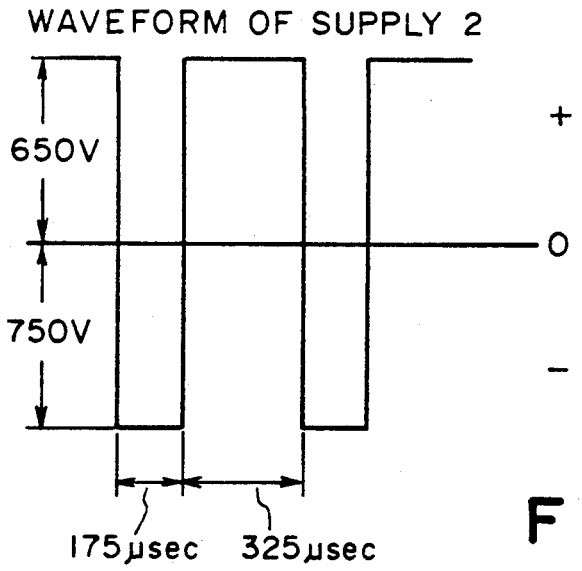
Figure 6:
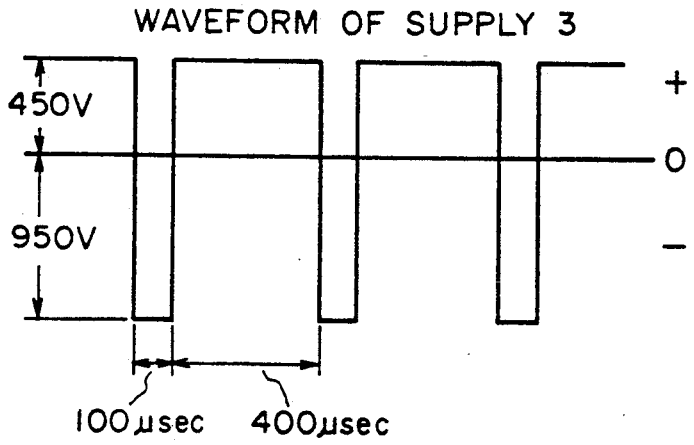
Figure 7:
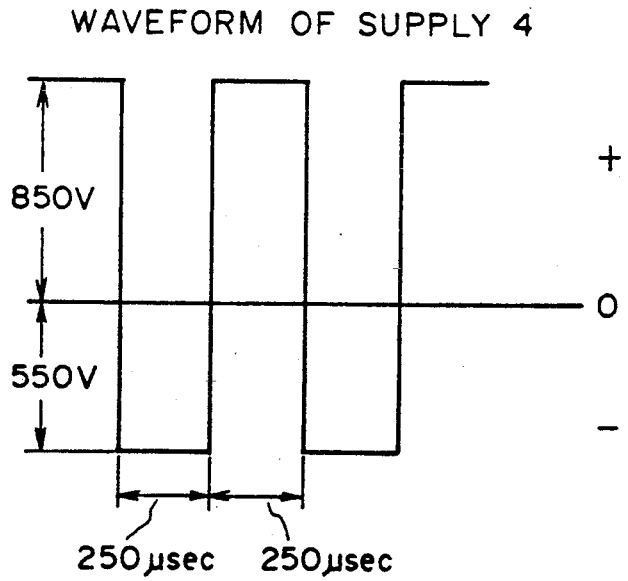
FIG. 7 is a waveform diagram showing a symmetrical alternating bias voltage.

At this time, as the reverse development-side electric field is suppressed to be low, toner particles of 8–12 microns which constitute an essential component of toner coverage are not peeled. FIG. 4 shows an example of the alternating bias voltage waveform used in the present invention.

The reverse development-side bias electric field is weak but the duration thereof is prolonged so that the effective force for peeling from the latent image-bearing member remains identical. The toner image attached to the toner image is not disturbed so that a good image with a gradation characteristic is attained.

Toner particles of 5 microns or smaller are effectively consumed by the development-side bias to accomplish a high image quality and do not stick to the surface of a developing sleeve, so that the decrease in image density of toner-carrying member memory is not liable to occur. The same also holds true with toner particles of 8–12.7 microns. Thus, these particles are sufficiently used for development under the action of the development-side bias voltage to accomplish high image density and gradation characteristic but are not peeled from the latent image-bearing member under the action of the reverse development-side bias, so that middle dropout and disturbance of line images can be obviated.

Under the action of the developing bias voltage according to the present invention, when ears formed of a toner fly and the tips of the ears touch the latent image-bearing member, the toner particles in the neighborhood of the ear tips, particles of a small particle size and particles having a large charge are attached to the latent image-bearing member for effecting development because of the image force, whereas the particles constituting the trailing ends or particles having a small charge are returned to the toner-carrying member under the action of the reverse development-side bias. Thus, the ears tend to be broken so that difficulties such as tailing and scattering due to ears can be alleviated. As the magnetic toner used in the invention tends to form uniform and small ears, so that the effect is enhanced.

The magnetic toner having a specific particle size distribution on the sleeve is successively supplied to latent images under the action of the developing bias according to the invention, so that shortage of toner coverage is not caused.

According to the alternating bias electric field used in the present invention, the development-side-bias electric field is so strong as to cause toner particles near the sleeve surface fly, so that toner particles having a large charge are more intensively used for development of a latent image pattern. As a result, toner particles having a large charge are firmly attached onto even a weak latent image pattern due to an electrostatic force, so that an image having a sharp edge can be obtained at a high resolution. Further, magnetic toner particles of 5 microns or smaller effective for realizing a high quality image is effectively used to provide a good image.

In case where the binder resin has an overall total acid value (A) exceeding 100 mgKOH/g or contains no acid anhydride group, the resultant magnetic toner fails to have a sufficient charge, and magnetic toner particles of 8–12.7 microns are peeled from the latent image-bearing member by the reverse development-side bias voltage, so that the coverage with the magnetic toner becomes worse, thus being liable to cause middle dropout and disturbance of line images. As the flying of magnetic toner particles is also decreased, it becomes difficult to obtain a sufficient image density, thus resulting in poor image quality.

On the other hand, if the total acid value (B) attributable to the acid anhydride group exceeds 6 mgKOH/g or 60% of the overall total acid value (A), it becomes difficult for magnetic toner particles of 5 microns or smaller to fly even by application of the development-ride bias voltage according to the present invention, so that a high image quality attributable to magnetic toner particles of 5 microns or smaller cannot be realized. Further, these fine toner particles are liable to be accumulated on the toner carrying member, so that triboelectrification of the other particles in hindered to result in deterioration of developing performance, decrease in image density, toner-carrying member memory, roughening of images and fog.

Herein, in case where the toner particles of 16 microns or larger exceeds 2 vol. %, it may be considered to increase the content of acid anhydride to increase the chargeability of the toner so as to prevent selective development.

In this case, however, as the content of large particles is increased, a high-image quality aimed at by the present invention cannot be realized and there are encountered difficulties, such as resolution failure of line and character images due to excessive coverage and scattering. Further, it becomes difficult to prevent the adherence of toner particles of 5 microns or smaller onto the toner-carrying member, so that the decrease in image density and toner-carrying member memory can be caused even by application of the developing bias voltage according to the present invention.

In the developing method used in the present invention, a satisfactory development may be effected for a gap of from 0.1 mm to 0.5 mm between the developing sleeve 22 and the latent image-bearing member 1 while 0.3 mm was representatively used in Examples described hereinafter. This is because a higher development-side bias allows a larger gap between the developing sleeve and the latent image-bearing member than in the conventional developing method.

A satisfactory image can be obtained if the absolute value of the alternating bias voltage is 1.0 kV or higher. Taking a possible leakage to the latent image-bearing member into consideration, the peak-to-peak voltage of the alternating bias voltage may preferably be 1.0 kV or higher and 2.0 kV or lower. The leakage can of course change depending on the gap between the developing sleeve 22 and the latent image-bearing member 1.

The frequency of the alternating bias may preferably be 1.0 kHz to 5.0 kHz. If the frequency is below 1.0 kHz, a better gradation can be attained but it becomes difficult to dissolve the ground fog. This is presumably because, in such a lower frequency region where the frequency of the reciprocal movement of the toner is smaller, the force of pressing toner onto the latent image-bearing member due to the development-side becomes excessive even onto a non-image part, so that a portion of toner attached onto the non-image part cannot be completely removed by the peeling force due to the reverse development-side bias electric field. On the other hand, at a frequency above 5.0 kHz, the reverse development-side bias electric field is applied before the toner sufficiently contacts the latent image-bearing member, so that the developing performance is remarkably lowered. In other words, the toner per se cannot respond to such a high frequency electric field.

In the present invention, a frequency of the alternating bias electric field in the range of 1.5 kHz to 3 kHz provided an optimum image quality.

The duty factor of the alternating bias electric field waveform according to the present invention may be substantially below 50%, preferably be a value satisfying: 10% ≦duty factor≦40%. If the duty factor is above 40%, the above-mentioned defects become noticeable to fail to achieve the improvement in image quality according to the present invention. If the duty factor is below 10%, the response of the toner to the alternating bias electric field becomes poor to lower the developing performance. The duty factor may optimally be in the range of 15 to 35% (inclusive).

The alternating bias waveform may for example be in the form of a rectangular wave, a sine-wave, a saw-teeth wave or a triangular wave.

As a test for evaluating the developing characteristic of a magnetic toner, a magnetic toner having a particle size distribution ranging from 0.5 microns to 30 microns was used for developing latent images on a photosensitive member having various surface potential contrasts ranging from a large potential contrast at which a majority of toner particles were readily used for development, through a half tone contrast and to a small potential contrast at which a slight portions of toner particles were used for development. Then, the toner particles used for developing the latent images were recovered from the photosensitive member for measurement of the particle size distribution. As a result, it was found that the proportion of magnetic toner particles of 8 microns or smaller, particularly magnetic toner particles of 5 microns or smaller, was increased. It was also found that latent images were faithfully developed without enlargement and at a good reproducibility when magnetic toner particles of 5 microns or smaller most suitable for development were smoothly supplied to latent images on the photosensitive member.

It is preferred that the magnetic toner according to the present invention contains 12% by number or more of magnetic toner particles having a particle size of 5 microns or smaller. Hitherto, it has been difficult to control the charge imparted to magnetic toner particles of 5 microns or smaller so that these small particles are liable to be charged excessively. For this reason, magnetic toner particles of 5 microns or smaller have been considered to have a strong image force onto a developing sleeve and are firmly attached to the sleeve surface to hinder triboelectrification of the other particles and cause insufficiently charged toner particles, thus resulting in roughening of images and a decrease in image density. Thus, it has been considered necessary to decrease magnetic toner particles of 5 microns or smaller.

As a result of our study, however, it has been found that magnetic toner particles of 5 microns or smaller constitute an essential component for providing images of a high quality.

According to the developing method of the present invention, toner particles of 5 microns or smaller are effectively caused to fly and prevented from sticking onto the sleeve surface.

It is also preferred in the magnetic toner used in the present invention that toner particles of 8–12.7 microns constitute 33% by number or less. This is related with the above-mentioned necessity of the magnetic toner particles of 5 microns or smaller. Magnetic toner particles of 5 microns or smaller are able to strictly cover and faithfully reproduce a latent image, but a latent image per se has a higher electric field intensity at the peripheral edge than the middle or central portion. As a result, toner particles are attached to the central portion in a smaller thickness than to the peripheral part, so that the inner part is liable to be thin in density. This tendency is particularly observed by magnetic toner particles of 5 microns or smaller. We have found that this problem can be solved to provide a clear image by using toner particles of 8–12.7 microns in a proportion of 33% by number or less. This may be attributable to a fact that magnetic toner particles of 8–12.7 microns are supplied to an inner part having a smaller intensity than the edge of a latent image presumably because they have a moderately controlled charge relative to magnetic toner particles of 5 microns or smaller, thereby to compensate for the less coverage of toner particles and result in a uniform developed image. As a result, a sharp image having a high density and excellent in resolution and gradation characteristic can be attained.

It is preferred that toner particles of 5 microns or smaller are contained in a proportion of 12 –60% by number. Further, in case where the volume-average particle size is 6–10 microns, preferably 7–10 microns, it is preferred that the contents of the toner particles of 5 microns or smaller in terms of % by number (N %) and % by volume (V %) satisfy the relationship of $N/V=-0.04N+k$, wherein $4.5 \leqq k \leqq 6.5$, and $12 \leqq N \leqq 60$. The magnetic toner having a particle size distribution satisfying the relationship according to the present invention accomplishes a better developing performance.

We have found a certain state of presence of fine powder accomplishing the intended performance satisfying the above formula during our study on the particle size distribution with respect to particles of 5 microns or smaller. With respect to a value of N in the range of $12 \leqq N \leqq 60$, a large N/V value is understood to mean that a large proportion of particles smaller than 5 microns are present with a broad particle size distribution, and a small N/V value is understood to mean that particles having a particle size in the neighborhood of 5 microns is present in a large proportion and particles smaller than that are present in a small proportion. Within the range of 12–60 for N, a further better thin-line reproducibility and high resolution are accomplished when the N/V is in the range of 2.1–5.82 and further satisfy the above formula relationship.

Magnetic toner particles of 16 microns or larger is suppressed to be not more than 2.0% by volume. The fewer, the better.

The particle size distribution of the magnetic toner used in the present invention is described more specifically below.

Magnetic toner particles of 5 microns or smaller may be contained in a proportion of 12% by number or more, preferably 12–60% by number, further preferably 17–60% by number, of the total number of particles. If the content of the magnetic toner particles of 5 microns or smaller is below 12% by number, a portion of the magnetic toner particles effective for providing a high image quality is few and particularly, as the toner is consumed during a continuation of copying or printing-out, the effective component is preferentially consumed to result in an awkward particle size distribution of the magnetic toner and gradually deteriorates the image quality. If the content is above 60% by number, mutual agglomeration of the magnetic toner particles is liable to occur to produce toner lumps having a larger size than the proper size, thus leading to difficulties, such as rough image quality, a low resolution, a large difference in density between the contour and interior of an image to provide a somewhat hollow image.

According to our study, it has been found that magnetic toner particles of 5 microns or smaller constitute an essential component for stabilizing the volume-average particle size of the magnetic toner on the developing sleeve during a successive image forming or copying operation.

During a successive image formation, magnetic toner particles of 5 microns or smaller which are most suitable for development are consumed in a large amount, so that if the amount of the particles of this size is small, the volume-average of the magnetic toner on the sleeve is gradually increased and the mass on the sleeve M/S ($mg/cm^2$) is increased to make the uniform toner coating on the sleeve difficult.

It is preferred that the content of the particles in the range of 8–12.7 microns is 33% by number or less, further preferably 1–33% by number. Above 33% by number, the image quality becomes worse, and excess of toner coverage is liable to occur, thus resulting in an increased toner consumption. Below 1% by number, it becomes difficult to obtain a high image density in some cases. The contents of the magnetic toner particles of 5 microns or smaller in terms of % by number (N %) and % by volume (V %) may preferably satisfy the relationship of $N/V = -0.04N + k$, wherein k represents a positive number satisfying $4.5 \leqq k \leqq 6.5$, preferably $4.5 \leqq k \leqq 6.0$, and N is a number satisfying $12 \leqq N \leqq 60$. The volume-average particle size at this time may be 4–10 microns.

If $k \leqq 4.5$, magnetic toner particles of 5.0 microns or below are insufficient, and the resultant image density, resolution and sharpness decrease. When fine toner particles in a magnetic toner, which have conventionally been considered useless, are present in an appropriate amount, they are effective for achieving closest packing of toner in development and contribute to the formation of a uniform image free of coarsening. Particularly, these particles fill thin-line portions and contour portions of an image, thereby to visually improve the sharpness thereof. If $k \leqq 4.5$ in the above formula, such component becomes insufficient in the particle size distribution, and the above-mentioned characteristics become poor.

Further, in view of the production process, a large amount of fine powder must be removed by classification in order to satisfy the condition of $k < 4.5$. Such a process is however disadvantageous in yield and toner costs. On the other hand, if $k > 6.5$, an excess of fine powder is present, whereby the balance of particle size distribution can be disturbed during successive copying or print-out, thus leading to difficulties such as increased toner agglomeration, failure in effective triboelectrification, cleaning failure and occurrence of fog.

In the magnetic toner of the present invention, the amount of magnetic toner particles having a particle size of 16 microns or larger is preferably 2.0% by volume or smaller, further preferably 1.0% by volume or smaller, more preferably 0.5% by volume or smaller. If the above amount is larger than 2.0% by volume, these particles not only are liable to impair thin-line reproducibility but also can cause transfer failure images because coarse particles of 16 microns or larger are present after development on the photosensitive member in the form of projections above a thin toner layer to irregularize the delicate contact between the photosensitive member and a transfer paper by the medium of the toner layer, thus resulting in change in transfer conditions leading to transfer failure.

In the image forming method of the present invention, toner particles of 16 microns or larger cannot be flied onto the latent image-bearing member unless they are sufficiently charged, so that they are liable to remain on the toner-carrying member to cause a change in particle size distribution, binder the triboelectrification of other toner particles to lower the developing performance, and disturb the shape toner ears, thus causing deterioration of image qualities.

In contrast with the magnetic toner particles of 5 microns or smaller, magnetic toner particles of 16 microns or larger are relatively less consumable in successive image formation. Accordingly, if they are contained in a proportion exceeding 2.0% by volume, the volume-average particle size of the magnetic toner on the sleeve is gradually increased to result in an increase in M/S on the sleeve, which is not desirable.

The magnetic toner used in the present invention may preferably have a volume-average particle size of 4–10 microns, further preferably 4–9 microns. This valve cannot be considered separately from the above-mentioned factors. If the volume-average particle size is below 4 microns, a problem of insufficient toner coverage on a transfer paper is liable to be caused for an image having a high image area proportion, such as a graphic image. This is considered to be caused by the same reason as the problem that the interior of a latent image is developed at a lower density than the contour. If the volume-average particle size exceeds 10 microns, a good resolution may not be obtained and the particle size distribution is liable to be changed on continuation of copying to lower the image quality even if it is satisfactory at the initial stage of copying.

The magnetic toner used in the present invention having a specific particle size distribution is capable of faithfully reproducing even thin lines of a latent image formed on the photosensitive member and is also excellent in reproducibilities in dot images, such as halftone dots and digital dots to provide images excellent in gradation and resolution. Further, even when the copying or printing out is continued, it is possible to maintain a high image quality and well develop a high-density image with a less toner consumption than a conventional magnetic toner, so that the magnetic toner of the present invention is advantageous in respect of economical factor and reduction in size of a copying machine or printer main body.

The developing method applied to the magnetic toner according to the present invention allows more effective accomplishment of the above effect.

The particle size distribution of a toner is measured by means of a Coulter counter in the present invention, while it may be measured in various manners.

Coulter counter Model TA-II (available from Coulter Electronics Inc.) is used as an instrument for measurement, to which an interface (available from Nikkaki K. K.) for providing a number-basis distribution, and a volume-basis distribution and a personal computer CX-1 (available from Canon K. K.) are connected.

For measurement, a 1%-NaCl aqueous solution as an electrolytic solution is prepared by using a reagent-grade sodium chloride. For example, ISOTON®-II (available from Coulter Scientific Japan K. K.) may be used therefor. Into 100 to 150 ml of the electrolytic solution, 0.1 to 5 ml of a surfactant, preferably an alkylbenzenesulfonic acid salt, is added as a dispersant, and 2 to 20 mg of a sample is added thereto. The resultant dispersion of the sample in the electrolytic liquid is subjected to a dispersion treatment for about 1–3 minutes by means of an ultrasonic disperser, and then subjected to measurement of particle size distribution in the range of 2–40 microns by using the above-mentioned Coulter counter Model TA-II with a 100 micron-aperture to obtain a volume-basis distribution and a number-basis distribution. Form the results of the volume-basis distribution and number-basis distribution, parameters characterizing the magnetic toner of the present invention may be obtained.

The electric charge data of a toner layer on a developing sleeve described herein are based on valves measured by the so-called suction-type Faraday cage method. More specifically, according to the Faraday cage method, an outer cylinder of a Faraday cage is pressed against the developing sleeve and the toner disposed on a prescribed area of the sleeve is sucked to be collected by the filter on the inner cylinder, whereby the toner layer weight in a unit area may be calculated from the weight increase of the filter. Simultaneously, the charge accumulated in the inner cylinder which is isolated from the exterior is measured to obtain the charge on the sleeve.

In the present invention, "thin-line reproducibility" was evaluated in the following manner. An original of a thin line image having a width of accurately 100 microns is copied under suitable copying conditions to provide a sample copy for measurement. The line width of the toner image on the copy is measured on a monitor of Luzex 400 Particle Analyzer. The line width is measured at several points along the length of the thin line toner image so as to provide an appropriate average value in view of fluctuations in width. The value of thin line reproducibility (%) is calculated by the following formula:

$$\frac{\text{Measured line-width of a copy image}}{\text{Line width (100 } \mu\text{m) on the original}} \times 100$$

In the present invention, the resolution was evaluated in the following manner. An original sheet having 10 original line images each comprising 5 lines spaced from each other with an identical value for line width and spacing is provided. The 10 original images comprise the 5 lines at pitches of 2.8, 3.2, 3.6, 4.0, 4.5, 5.0, 5.6, 6.3, 7.1, 8.0. 9.0 and 10.0 lines/mm, respectively. The original sheet is copied under suitable conditions to obtain a sample copy on which each of the ten line images is observed through a magnifying glass and the maximum number of lines (lines/mm) of an image in which the lines can be discriminated from each other is identified as a resolution measured. A larger number indicates a higher resolution.

Hereinbelow, the present invention will be explained in more detail based on Examples. Hereinbelow, "part(s)" used for describing a formation or composition are by weight.

First of all, Synthesis Examples of binder resins used for producing toners for developing electrostatic images according to the present invention and toners for comparisons will be explained. The total acid value (A), JIS acid value, total acid value (B) attributable to acid anhydride, and value of [(B)/(A)]×100 of binder resins and intermediate resins thus produced are summarized in Tables 1 and 2 appearing hereinafter.

SYNTHESIS EXAMPLE 1

| | |
|---|---|
| Styrene | 76.5 wt. parts |
| Butyl acrylate | 13.5 wt. parts |
| Monobutyl maleate | 10.0 wt. parts |
| Di-tert-butyl peroxide | 6.0 wt. parts |

The above ingredients in mixture were added dropwise in 4 hours into 200 wt. parts of xylene heated to the reflux temperature. The polymerization was further continued and completed under reflux of xylene (138°–144° C,). The system was further heated up to 200° C. under a reduced pressure to distill off the xylene. The resultant resin is referred to as a resin A.

SYNTHESIS EXAMPLE 2

| | |
|---|---|
| Styrene | 67.5 wt. parts |
| Butyl acrylate | 17.5 wt. parts |
| Monobutyl maleate | 15.0 wt. parts |
| Di-tert-butyl peroxide | 6.0 wt. parts |

The above ingredients were used otherwise in the same manner as in Synthesis Example 1 to obtain a resin B.

SYNTHESIS EXAMPLE 3

| | |
|---|---|
| Styrene | 67.5 wt. part(s) |
| Butyl acrylate | 17.5 wt. part(s) |
| Monobutyl maleate | 15.0 wt. part(s) |
| Divinylbenzene | 0.5 wt. part(s) |

-continued

| | |
|---|---|
| Di-tert-butyl peroxide | 6.0 wt. part(s) |

The above ingredients were used otherwise in the same manner as in Synthesis Example 1 to obtain a resin C.

SYNTHESIS EXAMPLE 4

A resin D was prepared by heating the resin A at 150° C. under vacuum for 6 hours.

SYNTHESIS EXAMPLE 5

The resin B was pulverized and stirred in a mixture liquid of dioxane/water/pyridine/dimethylaminopyridine for 6 hours to obtain a resin E.

SYNTHESIS EXAMPLE 6

| | |
|---|---|
| Styrene | 76.5 wt. parts |
| Butyl acrylate | 13.5 wt. parts |
| Monobutyl fumarate | 10.0 wt. parts |
| Di-tert-butyl peroxide | 6.0 wt. parts |

The above ingredients were used otherwise in the same manner as in Synthesis Example 1 to obtain a resin F.

SYNTHESIS EXAMPLE 7

| | |
|---|---|
| Styrene | 76.5 wt. parts |
| Butyl acrylate | 13.5 wt. parts |
| Monobutyl n-butenylsuccinate | 10.0 wt. parts |
| Di-tert-butyl peroxide | 6.0 wt. parts |

The above ingredients were used otherwise in the same manner as in Synthesis Example 1 to obtain a resin G.

TABLE 1

| Resin | Total acid value (A) | JIS acid value | Presence of IR absorption peak at 1780 $cm^{-1}$ (acid anhydride group) |
|---|---|---|---|
| Resin A | 46.9 | 29.5 | Yes |
| B | 80.8 | 46.8 | Yes |
| C | 76.8 | 48.8 | Yes |
| D | 59.6 | 31.5 | Yes |
| E | 80.5 | 80.6 | No |
| F | 41.6 | 31.5 | Yes |
| G | 41.9 | 23.3 | Yes |

SYNTHESIS EXAMPLE 8

| | |
|---|---|
| Resin A | 30.0 wt. part(s) |
| Styrene | 46.0 wt. part(s) |
| Butylacrylate | 21.0 wt. part(s) |
| Monobutyl maleate | 3.0 wt. part(s) |
| Divinylbenzene | 0.4 wt. part(s) |
| Benzoyl peroxide | 1.5 wt. part(s) |

Into a mixture of the above ingredients, 170 wt. parts of water containing 0.12 wt. part of partially saponified polyvinyl alcohol was added under vigorous stirring to form a suspension liquid. Into a reaction vessel containing 50 wt. parts of water and aerated with nitrogen, the above suspension liquid was added and subjected to 8 hours of suspension polymerization at 80° C. After the reaction, the product was washed with water, dewatered and dried to obtain a resin H.

The resultant resin H was found to contain 73.3 mol. % of monobutyl maleate units, 6.7 mol. % of maleic anhydride units and 20 mol. % of maleic acid units with respect to the total of these units as 100 mol. %.

SYNTHESIS EXAMPLE 9

| | |
|---|---|
| Resin B | 30.0 wt. part(s) |
| Styrene | 45.0 wt. part(s) |
| Butyl acrylate | 20.0 wt. part(s) |
| Monobutyl maleate | 5.0 wt. part(s) |
| Divinylbenzene | 0.4 wt. part(s) |
| Benzoyl peroxide | 1.5 wt. part(s) |

A resin I was prepared by using the above mixture liquid otherwise in the same manner as in Synthesis Example 8.

SYNTHESIS EXAMPLE 10

| | |
|---|---|
| Resin C | 30.0 wt. part(s) |
| Styrene | 48.0 wt. part(s) |
| Butyl acrylate | 22.0 wt. part(s) |
| Divinylbenzene | 0.4 wt. part(s) |
| Benzoyl peroxide | 1.5 wt. part(s) |

A resin J was prepared by using the above mixture liquid otherwise in the same manner as in Synthesis Example 8.

SYNTHESIS EXAMPLE 11

A resin K was prepared in the same manner as in Synthesis Example 8 except that the resin D was used instead of the resin A.

SYNTHESIS EXAMPLE 12

A resin L was prepared in the same manner as in Synthesis Example 9 except that the resin E was used instead of the resin B.

SYNTHESIS EXAMPLE 13

| | |
|---|---|
| Resin F | 30.0 wt. part(s) |
| Styrene | 46.0 wt. part(s) |
| Butyl acrylate | 21.0 wt. part(s) |
| Monobutyl fumarate | 3.0 wt. part(s) |
| Divinylbenzene | 0.4 wt. part(s) |
| Benzoyl peroxide | 1.5 wt. part(s) |

A resin M was prepared by using the above mixture liquid otherwise in the same manner as in Synthesis Example 8.

SYNTHESIS EXAMPLE 14

A resin N was prepared in the same manner as in Synthesis Example 8 except that the resin G was used instead of the resin A.

TABLE 2

| Binder resin | Intermediate resin | Binder Resin: Total acid value (A) | JIS acid value | Total acid value (B) | [(B)/(A)] × 100(%) | Presence of IR peak at 1780 $cm^{-1}$ |
|---|---|---|---|---|---|---|
| H | A | 21.3 | 20.0 | 2.6 | 12 | Yes |
| I | B | 34.6 | 33.8 | 1.6 | 5 | Yes |
| J | C | 21.9 | 19.0 | 5.8 | 26 | Yes |
| K | D | 26.9 | 25.5 | 2.8 | 10 | Yes |
| (Comparative) L | E | 38.8 | 38.7 | — | — | No |
| M | F | 22.6 | 22.0 | 1.2 | 5 | Yes |
| N | G | 22.8 | 21.8 | 2.0 | 9 | Yes |
| (Comparative) O | — | 30.2 | 18.5 | 24.0 | 79 | Yes |
| (Comparative) P | — | 16.3 | 16.3 | — | — | No |

SYNTHESIS EXAMPLE 15

| | |
|---|---|
| Styrene | 70.0 wt. part(s) |
| Butyl acrylate | 23.0 wt. part(s) |
| Monobutyl maleate | 6.0 wt. part(s) |
| Divinylbenzene | 1.0 wt. part(s) |
| Di-tert-butyl peroxide | 4.0 wt. part(s) |

A resin O was prepared by using the above mixture liquid otherwise in the same manner as in Synthesis Example 1 by solution polymerization.

SYNTHESIS EXAMPLE 16

| | |
|---|---|
| Styrene | 70.5 wt. part(s) |
| Butyl acrylate | 23.0 wt. part(s) |
| Monobutyl maleate | 6.0 wt. part(s) |
| Divinylbenzene | 0.5 wt. part(s) |
| Benzoyl peroxide | 1.5 wt. part(s) |

A resin P was prepared by using the above mixture liquid otherwise in the same manner as in Synthesis Example 8 by suspension polymerization.

EXAMPLE 1

| | |
|---|---|
| Resin H (binder resin) | 100 wt. part(s) |
| Magnetic iron oxide ($\overline{Dn}$ (number-average particle size) = 0.18 μm; Hc = 121 Oe (Oersted), $\sigma_s$ = 83.4 emu/g, $\sigma_r$ = 11.7 emu/g under application of 10 KOe) | 60 wt. part(s) |
| Low-molecular weight ethylene-propylene copolymer | 3 wt. part(s) |
| Monoazo complex (negative charge control agent) | 1 wt. part(s) |

The above ingredients were pre-blended in a Henschel mixer and melt-kneaded at 130° C. by means of a two-axis extruder. The kneaded product was cooled by standing, coarsely crushed by a cutter mill, finely pulverized by a pulverizer using jet air stream, and classified by a wind-force classifier to obtain a black fine powder (magnetic toner) having a volume-average particle size of 11 microns.

To 100 wt. parts of the magnetic toner, 0.4 wt. part of hydrophobic dry-process silica (BET 200 $m^2/g$) was added, and the mixture was sufficiently blended in a Henschel mixer. The thus obtained magnetic toner was subjected to a copying test of 10,000 sheets by means of a high-speed electrophotographic copying machine having a copying speed of 82 sheets (A4)/min. ("NP-8580", made by Canon, loaded with an a-Si (amorphous silicon) photosensitive drum, for normal development of electrostatic images of positive charge).

The results under the conditions of temperature 15° C.-humidity 10%RH are shown in Table 3, and the results under the conditions of temperature 32.5° C.—humidity 85%RH are shown in Table 4, respectively appearing hereinafter.

As is clear from these tables, clear images having a high density and free of fog were obtained.

EXAMPLES 2-6

Magnetic toners each having a volume-average particle size of 11 microns were obtained by replacing the resin H with the resins I, J, K, L, M and N, respectively, otherwise in the same manner as in Example 1, and then externally blended with the hydrophobic silica similarly as in Example 1.

The thus-obtained magnetic toners were subjected to the same copying test as in Example 1, whereby good images were obtained in the respective cases as shown in Tables 3 and 4.

EXAMPLE 7

| | |
|---|---|
| Resin J | 80 wt. part(s) |
| Polyester resin (total acid value = 18) | 20 wt. part(s) |
| Perylene Scarlet | 3 wt. part(s) |
| Low-molecular weight ethylene-propylene copolymer | 3 wt. part(s) |

A red fine powder (non-magnetic toner) having a volume-average particle size of 11 microns was prepared by using the above ingredients otherwise in the same manner as in Example 1, and 100 wt. parts thereof was sufficiently blended with a hydrophobic dry-process silica (BET 200 $m^2/g$).

8 wt. parts of the toner blended with the silica fine powder was further blended with 100 wt. parts of acrylic resin-coated ferrite carrier particles to obtain a two-component type developer.

The two-component type developer was subjected to a copying test of 10,000 sheets by means of a commercially available electrophotographic copying machine ("NP-6650", made by Canon).

Under the conditions of 15° C.—10%RH, the resultant images showed a density of 1.25 at the initial stage and 1.27 on the 10,000-th copy and no fog was observed. Further, under the conditions of 32.5° C.—85%RH, clear red images were obtained showing 1.20 at the initial stage and 1.24 on the 10,000-th copy.

EXAMPLE 8

| | |
|---|---|
| Resin H | 80 wt. part(s) |
| Styrene-butadiene copolymer | 20 wt. part(s) |
| Magnetic iron oxide | 80 wt. part(s) |
| ($\overline{Dn}$ = 0.17 μm; Hc = 110 Oe, $\sigma_s$ = 80 emu/g, $\sigma_r$ = 11 emu/g) | |
| Low-molecular weight ethylene-propylene copolymer | 4 wt. part(s) |
| Nigrosine | 2 wt. part(s) |

A black fine powder (positively chargeable insulating magnetic toner) having a volume-average particle size of 8.5 microns was prepared by using the above ingredients otherwise in the same manner as in Example 1. Then, 0.6 wt. part of a positively chargeable hydrophobic dry-process silica (BET 150 $m^2/g$) was added to 100 wt. parts of the magnetic toner, and the mixture was well blended in a Henschel mixer.

The thus prepared toner was subjected to a copying test of 10,000 sheets by means of a commercially available copying machine ("NP-4835", made by Canon, Loaded with an OPC photosensitive drum, for normal development of electrostatic images of negative charge).

Under the conditions of 15° C.—10%RH, clear images free from fog were obtained, showing densities of 1.37 at the initial stage and 1.39 on the 10,000-th sheet. Further, under 32.5° C.—85%RH, images free from fog were obtained showing 1.30 at the initial stage and 1.32 on the 10,000-th sheet.

COMPARATIVE EXAMPLES 1-3

Magnetic toners each having a volume-average particle size of 11 microns were prepared by using the resins L, O and P, respectively, instead of the resin H otherwise in the same manner as in Example 1. The resultant toners were subjected to the same copying test as in Example 1, whereby the results shown in Tables 3 and 4 were obtained. In each of Tables 3 and 4, the image evaluation with respect to fog is denoted based on results by observation with eyes according to the following standards:

: excellent, ◎: Good,

Δ:fair, x: not acceptable.

As shown in the Tables, images showing low densities were obtained under 32.5° C.—82.5%RH in Comparative Examples 1 and 3.

In comparative Example 2, under 15° C.—10%RH, good images were obtained at the initial stage but the image density was gradually lowered on continuation of the copying until rough images were obtained.

TABLE 3

| | Binder resin | (Under 15° C. - 10% RH) Initial stage Image density | Fog | On 10,000th sheet Image density | Fog |
|---|---|---|---|---|---|
| Example | | | | | |
| 1 | H | 1.37 | ◎ | 1.39 | ◎ |
| 2 | I | 1.40 | ◎ | 1.41 | ◎ |
| 3 | J | 1.35 | ◎ | 1.38 | ◎ |
| 4 | K | 1.37 | ◎ | 1.40 | ◎ |
| 5 | M | 1.33 | ○ | 1.35 | ◎ |
| 6 | N | 1.34 | ○ | 1.34 | ○ |
| Comp. Example | | | | | |
| 1 | L | 1.28 | ○ | 1.27 | Δ |
| 2 | O | 1.42 | Δ | 1.06 | x |
| 3 | P | 1.27 | Δ | 1.33 | ○ |

TABLE 4

| | Binder resin | (Under 32.5° C. - 85% RH) Initial stage Image density | Fog | On 10,000th sheet Image density | Fog |
|---|---|---|---|---|---|
| Example | | | | | |
| 1 | H | 1.32 | ◎ | 1.34 | ◎ |
| 2 | I | 1.36 | ◎ | 1.38 | ◎ |
| 3 | J | 1.30 | ◎ | 1.31 | ◎ |
| 4 | K | 1.34 | ◎ | 1.33 | ◎ |
| 5 | M | 1.31 | ○ | 1.31 | ◎ |
| 6 | N | 1.30 | ◎ | 1.32 | ○ |
| Comp. Example | | | | | |
| 1 | L | 1.08 | Δ | 1.07 | ○ |
| 2 | O | 1.36 | Δ | 1.38 | ○ |
| 3 | P | 1.13 | ○ | 1.09 | Δ |

As described above, there is provided a toner for developing electrostatic images using a binder resin containing a specific functional group in a specific proportion, which exhibits the following advantageous effects:

(1) Toner images having a high density and free from fog can be obtained.

(2) Good toner images are provided even under low-humidity and high-humidity conditions without being affected by environmental changes.

(3) It stably provides good images even in a high-speed copying machine and is applicable to a wide variety of electrophotographic image-forming apparatus.

EXAMPLE 9

| | |
|---|---|
| Resin H | 100 wt. parts |
| Magnetic iron oxide | 80 wt. parts |
| Low-molecular weight ethylene-propylene copolymer | 4 wt. parts |
| Monoazo chromium complex | 2 wt. parts |

The above ingredients were well blended in a blender and melt-kneaded at 150° C. by means of a two-axis extruder. The kneaded product was cooled, coarsely crushed by a cutter mill, finely pulverized by means of a pulverizer using jet air stream, and classified by a fixed-wall type wind-force classifier (DS-type Wind-Force Classifier, mfd. by Nippon Pneumatic Mfg. Co. Ltd.) to obtain a classified powder product. Ultra-fine powder and coarse power were simultaneously and precisely removed from the classified powder by means of a multi-division classifier utilizing a Coanda effect (Elbow Jet Classifier available from Nittetsu Kogyo K. K.), thereby to obtain a negatively chargeable insulating black fine powder (magnetic toner). The particle size distribution of the magnetic toner is shown in Table 5 appearing hereinafter.

100 wt. parts of the thus obtained magnetic toner and 0.6 wt. part of negatively chargeable hydrophobic dry process silica fine powder (BET specific surface area=300 $m^2/g$) were blended in a Henscel mixer to prepare a magnetic toner in which the silica fine powder was attached to the toner particle surfaces. The magnetic toner in this mixture state is referred to as Toner No. 1.

EXAMPLE 10

| | |
|---|---|
| Resin I | 100 wt. parts |
| Magnetic iron oxide | 90 wt. parts |
| Low-molecular weight ethylene-propylene copolymer | 3 wt. parts |
| 3,5-Di-tert-butylsalicylic acid chromium complex | 2 wt. parts |

A negatively chargeable insulating magnetic toner having a particle size distribution as shown in Table 5 was prepared from the above ingredients otherwise in the same manner as in Example 9, and similarly blended with hydrophobic dry-process silica fine powder to obtain a toner No. 2.

EXAMPLE 11

| | |
|---|---|
| Resin J | 100 wt. parts |
| Magnetic iron oxide | 100 wt. parts |
| Low-molecular weight ethylene-propylene copolymer | 3 wt. parts |
| Monoazo chromium complex | 2 wt. parts |

A negatively chargeable insulating magnetic toner having a particle size distribution as shown in Table 5 was prepared from the above ingredients otherwise in the same manner as in Example 9, and 100 wt. parts thereof was blended with 0.8 wt. part of hydrophobic dry-process silica fine powder (BET=300 $m^2/g$) to obtain a toner No. 3.

EXAMPLE 12

| | |
|---|---|
| Resin M | 100 wt.parts |
| Magnetic iron oxide | 80 wt. parts |
| Low-molecular weight ethylene-propylene copolymer | 4 wt. parts |
| 3-5-Di-tert-butylsalicylic acid chromium complex | 2 wt. parts |

A negatively chargeable insulating magnetic toner having a particle size distribution as shown in Table 5 was prepared from the above ingredients otherwise in the same manner as in Example 9, and 100 wt. parts thereof was blended with hydrophobic dry-process silica fine powder (BET 200 $m^2/g$) obtain a toner No. 4.

Example toner No. 1–4 prepared above (and Comparative Example toners prepared as will be described hereinbelow) were subjected to a copying test by means of an apparatus which had been prepared by modifying a commercially available electrophotographic copying machine ("NP-8580", made by Canon K. K., loaded with an a-Si photosensitive drum, for normal development of electrostatic images of positive polarity) so as to be loaded with a modified power supply for applying a development bias voltage as briefly shown in FIG. 2. The gap $\sigma$ between the a-Si photosensitive drum 1 and the developing sleeve 22 was set at 0.3 mm, and the gap between the developing sleeve 22 and the magnetic doctor blade 24 was set at 0.25 mm to form a magnetic toner layer in a thickness of about 120 microns.

The particulars of the bias power supplies 1–4 used are summarized in Table 6, and the alternating electric field waveforms given thereby are schematically shown in FIGS. 4–7, which respectively show a superposition of an AC bias voltage given by an AC supply means $S_0$ and a DC bias voltage given by a DC supply means $S_1$.

EXAMPLE 13

A copying test of 50,000 sheets was conducted by using the toner 1 and the supply 1 under the compositions of temperature 15° C. and humidity 10%RH. The results are shown in Tables 7 and 8. Subsequently, a similar copying test of 50,000 sheets was conducted under the conditions of 32.5° C.—85%RH. The results are shown in Tables 9 and 10.

As is clear from the results in these tables, the toner provided high definition images having a high density and free from fog were obtained regardless of the environmental conditions. The charge on the sleeve was stable and no toner-carrying member memory was observed.

EXAMPLES 14–16

Similar copying tests as in Example 13 were conducted by using combinations of the toner 2 and the supply 2 (Example 14), the toner 3 and the supply 3 (Example 15), and the toner 4 and the supply 1 (Example 16). The results are also shown in Tables 7–10.

COMPARATIVE EXAMPLE 4

Similar copying tests as in Example 13 were conducted by using the magnetic toner having a volume-average particle size of 11 microns prepared in Comparative Example 1 and the power supply 1 in combination. The results are also shown in Tables 7–10.

Under the high temperature—high humidity conditions of 32.5° C.—85%RH, the image density was low and image deterioration was observed in an increased number of copied sheets in the durability test.

Under the low temperature—low humidity conditions of 15° C.—10%RH, good toner images were obtained at the initial stage of the durability test but deterioration in image quality was observed as the number of copied sheets increased.

COMPARATIVE EXAMPLE 5

Similar copying tests as in Example 13 were conducted by using the magnetic toner having a volume-average particle size of 11 microns prepared in Comparative Example 2 and the power supply 1 in combination. The results are also shown in Tables 7–10.

Under the low temperature—low humidity conditions of 15° C.-10%RH, good toner images were obtained at the initial stage of the durability test, but the image density was lowered and fog was observed as the number of copied sheets increased.

COMPARATIVE EXAMPLE 6

Similar copying tests as in Example 13 were conducted by using the magnetic toner having a volume-average particle size of 11 microns prepared in Comparative Example 13 and the power supply 4 (duty factor=50%) in combination. The results are also shown in Tables 7–10. The image evaluation with respect to fog and toner-carrying member memory was performed by observation with naked eyes and the results thereof are denoted by symbols as follows:

: excellent,
⊙: good,
Δ: fair,
x: not acceptable.

TABLE 5

| Toner | Particle size distribution of toner: % by number of particles of ≦5 μm | % by volume of particles of ≧16 μm | % by number of particles of 8–12.7 μm | Volume-average particle size (μm) | (% by number)/(% by volume) of particles of ≦5 μm |
|---|---|---|---|---|---|
| (Example) | | | | | |
| Toner 1 | 32.7 | 0.0 | 18.7 | 8.27 | 3.8 |
| 2 | 29.5 | 0.0 | 15.5 | 7.39 | 3.4 |
| 3 | 44.6 | 0.0 | 5.3 | 6.49 | 2.5 |
| 4 | 26.8 | 0.1 | 21.9 | 8.41 | 4.1 |
| Comp. Example | | | | | |
| 1 | 8.8 | 5.1 | 45.5 | 11.24 | 14.7 |
| 2 | 7.4 | 3.6 | 48.5 | 11.10 | 18.5 |
| 3 | 8.1 | 4.7 | 46.7 | 11.35 | 15.6 |

TABLE 6

| | AC voltage: Duty factor (%) | Frequency (Hz) | Peak-to-peak voltage (V) | DC voltage (V) | FIG. No. of waveform diagram |
|---|---|---|---|---|---|
| Supply 1 | 30 | 2000 | 1400 | +150 | FIG. 4 |
| 2 | 35 | 2000 | 1400 | +150 | FIG. 5 |
| 3 | 20 | 2000 | 1400 | +150 | FIG. 6 |
| 4 | 50 | 2000 | 1400 | +150 | FIG. 7 |

TABLE 7-continued (under 15° C. - 10% RH)

| | Initial stage: Dmax | Q/M* (μc/g) | After 50,000 sheets: Dmax | Q/M* (μc/g) | Volume-average particle size of tone on sleeve (μm) |
|---|---|---|---|---|---|
| 6 | 1.28 | −12.3 | 1.33 | −13.1 | 12.14 |

*Q/M: Toner charge on the developing sleeve.

TABLE 8

(under 15° C., 10% RH)

| | Initial stage: Fog | Toner carrying member memory | Thin-line reproducibility (%) | Resolution (line/mm) | After 50,000 sheets: Fog | Toner carrying member memory | Thin-line reproducibility (%) | Resolution (line/mm) |
|---|---|---|---|---|---|---|---|---|
| Example | | | | | | | | |
| 9 | ◎ | ◎ | 102 | 8.0 | ◎ | ◎ | 102 | 8.0 |
| 10 | ◎ | ◎ | 101 | 9.0 | ◎ | ◎ | 103 | 8.0 |
| 11 | ○ | ○ | 101 | 10.0 | ○ | ○ | 101 | 9.0 |
| 12 | ◎ | ◎ | 104 | 8.0 | ○ | ◎ | 105 | 7.1 |
| Comp. Example | | | | | | | | |
| 4 | ○ | ○ | 123 | 6.3 | ○ | ○ | 137 | 5.0 |
| 5 | ○ | ○ | 119 | 6.3 | Δ | Δ | 95 | 4.5 |
| 6 | ○ | Δ | 121 | 5.6 | ○ | Δ | 124 | 5.6 |

TABLE 7

(under 15° C. - 10% RH)

| | Initial stage: Dmax | Q/M* (μc/g) | After 50,000 sheets: Dmax | Q/M* (μc/g) | Volume-average particle size of tone on sleeve (μm) |
|---|---|---|---|---|---|
| Example | | | | | |
| 9 | 1.41 | −12.4 | 1.40 | −13.3 | 8.35 |
| 10 | 1.37 | −11.7 | 1.39 | −14.3 | 7.88 |
| 11 | 1.39 | −13.4 | 1.40 | −13.9 | 6.91 |
| 12 | 1.35 | −12.2 | 1.36 | −13.4 | 8.34 |
| Comparative Example | | | | | |
| 4 | 1.36 | −12.5 | 1.35 | −13.7 | 14.54 |
| 5 | 1.33 | −12.9 | 1.23 | −19.7 | 15.57 |

TABLE 9

(Under 32.5° C., 85% RH)

| | Initial stage: Dmax | Q/M* (μc/g) | After 50,000 sheets: Dmax | Q/M* (μc/g) | Volume-average particle size of tone on sleeve (μm) |
|---|---|---|---|---|---|
| Example | | | | | |
| 9 | 1.30 | −8.9 | 1.33 | −10.7 | 8.41 |
| 10 | 1.32 | −9.9 | 1.32 | −11.0 | 7.72 |
| 11 | 1.31 | −10.3 | 1.35 | −11.4 | 6.83 |
| 12 | 1.30 | −9.7 | −1.36 | −10.7 | 8.57 |
| Comparative Example | | | | | |
| 4 | 1.18 | −9.3 | 1.04 | −7.1 | 18.12 |
| 5 | 1.29 | −10.5 | 1.33 | −11.7 | 14.32 |
| 6 | 1.12 | −9.0 | 1.10 | −8.3 | 13.76 |

*Q/M: Toner charge on the developing sleeve.

TABLE 10

(under 32.5° C. - 85% RH)

| | Initial stage: Fog | Toner carrying member memory | Thin-line reproducibility (%) | Resolution (line/mm) | After 50,000 sheets: Fog | Toner carrying member memory | Thin-line reproducibility (%) | Resolution (line/mm) |
|---|---|---|---|---|---|---|---|---|
| Example | | | | | | | | |

TABLE 10-continued

| | (under 32.5° C. - 85% RH) | | | | | | | |
|---|---|---|---|---|---|---|---|---|
| | Initial stage | | | | After 50,000 sheets | | | |
| | Fog | Toner carrying member memory | Thin-line reproducibility (%) | Resolution (line/mm) | Fog | Toner carrying member memory | Thin-line reproducibility (%) | Resolution (line/mm) |
| 9 | ◎ | ◎ | 105 | 7.1 | ◎ | ◎ | 103 | 8.0 |
| 10 | ◎ | ◎ | 104 | 8.0 | ◎ | ◎ | 103 | 8.0 |
| 11 | ◎ | ◎ | 100 | 9.0 | ◎ | ◎ | 101 | 9.0 |
| 12 | ◎ | ◎ | 104 | 8.0 | ◎ | ◎ | 107 | 7.1 |
| Comp. Example | | | | | | | | |
| 4 | ○ | ◎ | 125 | 5.6 | ○ | ◎ | 85 | 4.5 |
| 5 | ◎ | ○ | 121 | 6.3 | ◎ | ○ | 131 | 5.0 |
| 6 | ◎ | ○ | 128 | 5.6 | Δ | Δ | 90 | 5.6 |

What is claimed is:

1. An image forming apparatus, comprising: a latent image-bearing member for holding an electrostatic image thereon, a toner-carrying member for carrying a layer of a magnetic toner thereon, a toner vessel for holding the magnetic toner to be supplied to the toner-carrying member, a toner layer-regulating member for regulating the magnetic toner layer on the toner-carrying member, and a bias application means for applying an alternating bias voltage comprising a DC bias voltage and an unsymmetrical AC bias voltage in superposition between the toner-carrying member and the latent image-bearing member, wherein the latent image-bearing member and the toner-carrying member are disposed with a prescribed gap therebetween at a developing station;

the toner layer-regulating means is disposed to regulate the magnetic toner layer on the toner-carrying member in a thickness thinner than the prescribed gap;

the magnetic toner comprises a binder resin and magnetic powder and has a volume-average particle size of 4–10 microns, the binder resin comprises a vinyl copolymer having an acid anhydride group, and the binder resin has a total acid value (A) of 2–100 mgKOH/g and a total acid value (B) attributable to acid anhydride group of below 6 mgKOH/g so that $[(B)/(A)]\times 100$ is 60% or less; and the bias application means is disposed to provide an alternating bias electric field comprising a development-side voltage component and a reverse-development side voltage component, the development-side voltage component having a magnitude equal to or larger than that of the reverse development-side voltage component and a duration smaller than that of the reverse-development side voltage component, so that the magnetic toner on the toner-carrying member is transferred to the latent image-bearing member to develop the electrostatic image thereon at the developing station.

2. The image forming apparatus according to claim 1, wherein the bias application means applies an alternating bias voltage having a frequency of 1.0–5.0 KHz.

3. The image forming apparatus according to claim 1, wherein the bias application means provides an alternating bias voltage having a duty factor of 10–40%.

4. The image forming apparatus according to claim 1, wherein the alternating bias voltage has a peak-to-peak value of 1.0–2.0 KV.

5. The image forming apparatus according to claim 1, wherein said alternating bias voltage has a frequency of 1.0–5.0 KHz, a peak-to-peak voltage of 1.0–2.0 KV and a duty factor of 10–40%, and the magnetic toner contains 12–60% by number of toner particles of 5 microns or smaller.

6. The image forming apparatus according to claim 1, wherein the latent image-bearing member comprises a photosensitive layer of a-Si.

* * * * *

UNITED STATES PATENT AND TRADEMARK OFFICE

CERTIFICATE OF CORRECTION

PATENT NO. : 5,212,524

DATED : May 18, 1993

INVENTOR(S) : HIROHIDE TANIKAWA, ET AL.

It is certified that error appears in the above-identified patent and that said Letters Patent is hereby corrected as shown below:

COLUMN 1

Line 66, "nonumiform" should read --nonuniform--.

COLUMN 2

Line 5, "nonumi-" should read --nonuni- --.
Line 7, "toner" should read --toners--.

COLUMN 3

Line 30, "[(B)/(A)9" should read --[(B)/(A)]--.

COLUMN 4

Line 41, "DESCRIPTION" should read --BRIEF DESCRIPTION--.
Line 53, "DESCRIPTION" should read --DETAILED DESCRIPTION--.

COLUMN 5

Line 14, "case" should read --a case--.
Line 48, "6 kgKOH/g" should read --6 mgKOH/g--.

COLUMN 6

Line 61, "acrylate," should read --acrylate;--.

COLUMN 7

Line 39, "trimethyle-" should read --trimethylole- --.
Line 40, "trimethylolethane" should read --tetramethylolmethane--.
Line 68, "according" should read --according to--.

--

UNITED STATES PATENT AND TRADEMARK OFFICE

CERTIFICATE OF CORRECTION

PATENT NO. : 5,212,524

DATED : May 18, 1993

INVENTOR(S) : HIROHIDE TANIKAWA, ET AL.

It is certified that error appears in the above-identified patent and that said Letters Patent is hereby corrected as shown below:

COLUMN 9

Line 26, (95 V/v %)" should read --(95 V/V %)--.
Line 32, "regents" should read --reagents--.

COLUMN 11

Line 10, "polycarboxylic" should read --poly-carboxylic--.
Lines 17-18, "as their homologous," should read --and their homologs,--.
Line 68, "agent" (first occurrence) should read --agent,--.

COLUMN 12

Line 54, "$\sigma_s$)" should read --($\sigma_s$)--.

COLUMN 13

Line 22, "are" should read --is--.

COLUMN 16

Line 22, "developer" should read --developer)--.
Line 50, "$(E \cdot E^0 \cdot q^2)/d^2$." should read --$(\epsilon \cdot \epsilon^0 \cdot q^2)/d^2$.--.

COLUMN 18

Line 5, "so that" should be deleted.
Line 23, "In case" should read --In the case--.
Line 45, "in" should read --is--.
Line 49, "in case" should read --in the case--.

--

UNITED STATES PATENT AND TRADEMARK OFFICE

CERTIFICATE OF CORRECTION

PATENT NO. : 5,212,524

DATED : May 18, 1993

INVENTOR(S) : HIROHIDE TANIKAWA, ET AL.

It is certified that error appears in the above-identified patent and that said Letters Patent is hereby corrected as shown below:

COLUMN 19

Line 21, "due to" should read --on the--.
Line 47, "saw-teeth" should read --saw-tooth--.

COLUMN 21

Line 12, "is" should read --are--.
Line 66, "k≦4.5," should read --k<4.5,--.

COLUMN 22

Line 8, "k≦4.5" should read --k<4.5--.
Line 45, "shape" should read --shape of the--.
Line 57, "valve" should read --value--.

COLUMN 23

Line 49, "valves" should read --values--.

COLUMN 29

Line 45, " :excellent, ⊙:Good," should read
--⊙:excellent, ○:good,--.

COLUMN 30

TABLE 4, "5 M 1.31 ∘ 1.31 ⊙" should read
--5 M 1.31 ⊙ 1.31 ⊙--.
Line 55, "power" should read --powder--.
Line 65, "Henscel" should read --Henschel--.

--

UNITED STATES PATENT AND TRADEMARK OFFICE

CERTIFICATE OF CORRECTION

PATENT NO. : 5,212,524

DATED : May 18, 1993

INVENTOR(S) : HIROHIDE TANIKAWA, ET AL.

It is certified that error appears in the above-identified patent and that said Letters Patent is hereby corrected as shown below:

COLUMN 32

Lines 61-64, boldface should be deleted.
Line 65, " :excellent," should read --◎:excellent,--.
Line 66, "◎:good," should read --○:good,--.

COLUMN 33

TABLE 7, "tone" should read --toner--.

COLUMN 34

TABLE 7-continued, "tone" should read --toner--.
TABLE 9, "tone" should read --toner--.

Signed and Sealed this

Twelfth Day of April, 1994

Bruce Lehman

*Attest:*

BRUCE LEHMAN

*Commissioner of Patents and Trademarks*

*Attesting Officer*

--